US012371959B2

(12) United States Patent
Zakharia et al.

(10) Patent No.: US 12,371,959 B2
(45) Date of Patent: Jul. 29, 2025

(54) RELEASE TOOL

(71) Applicant: G&H Diversified Manufacturing LP, Houston, TX (US)

(72) Inventors: Steven Zakharia, Houston, TX (US); Christian Atilano, Houston, TX (US); Ryan Ward, Tomball, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 76 days.

(21) Appl. No.: 18/229,091

(22) Filed: Aug. 1, 2023

(65) Prior Publication Data

US 2024/0035347 A1 Feb. 1, 2024

Related U.S. Application Data

(60) Provisional application No. 63/394,137, filed on Aug. 1, 2022.

(51) Int. Cl.

| | |
|---|---|
| ***E21B 17/06*** | (2006.01) |
| ***E21B 23/04*** | (2006.01) |
| *E21B 47/017* | (2012.01) |

(52) U.S. Cl.

CPC ..... *E21B 23/0414* (2020.05); *E21B 17/06* (2013.01); *E21B 23/042* (2020.05); *E21B 47/017* (2020.05)

(58) Field of Classification Search

CPC .... E21B 23/0414; E21B 17/06; E21B 23/042; E21B 47/017

See application file for complete search history.

(56) References Cited

U.S. PATENT DOCUMENTS

| | | | | |
|---|---|---|---|---|
| 5,984,006 | A * | 11/1999 | Read | E21B 17/028 285/376 |
| 10,794,122 | B2 | 10/2020 | Kitchen et al. | |
| 2013/0008669 | A1 | 1/2013 | Deere et al. | |
| 2013/0299193 | A1* | 11/2013 | Duong | E21B 33/04 166/208 |
| 2017/0226815 | A1* | 8/2017 | Zakharia | E21B 23/01 |
| 2023/0057040 | A1* | 2/2023 | Herndon | E21B 43/10 |

* cited by examiner

*Primary Examiner* — Nicole Coy
*Assistant Examiner* — Jennifer A Railey
(74) *Attorney, Agent, or Firm* — Conley Rose, P.C.

(57) ABSTRACT

A release tool for connecting a workstring to a toolstring. The release tool will be used for contingency if the toolstring gets stuck downhole and hopefully rarely would be actuated. In the present disclosure, the release tool is not broken or destroyed, but is simply disconnected into two parts using the propellent of a low explosive combustion element. This element produces gasses that drive the disconnecting process. The gasses are directed to press a tubular piston to translate from a first position where a wedging portion of the tubular piston is inside a lock ring bracing the lock ring in a locking configuration to a second position where the wedging portion is out of contact with the lock ring. The lock ring is then able to slip free from one or more locking grooves releasing the upper portion of the release tool from the lower.

30 Claims, 22 Drawing Sheets

RELEASE TOOL

CROSS-REFERENCE TO RELATED APPLICATIONS

This application claims benefit of U.S. provisional patent application Ser. No. 63/394,137 filed Aug. 1, 2022, and entitled "Release Tool," which is hereby incorporated herein by reference in its entirety for all purposes.

STATEMENT REGARDING FEDERALLY SPONSORED RESEARCH OR DEVELOPMENT

Not applicable.

BACKGROUND

Subterranean wellbores are drilled into hydrocarbon bearing, earthen formations in the interest of producing hydrocarbons from the wellbore. During completion operations for subterranean wellbores, it is conventional practice to install a tubular casing string or simply "casing" in the wellbore and then perforate the casing string with perforating guns located within a central passage of the casing string to provide many paths for formation fluids (e.g., hydrocarbons) to flow into a central passage of the casing string. The perforating guns are typically positioned along a toolstring that is conveyed into the wellbore via a wireline or other suitable workstring. The toolstring deployed into the wellbore may include, along with the perforating guns, various other components and equipment to assist with positioning the toolstring at a desired location within the casing string, and for sealing or plugging the casing string at the desired location. Following plugging and perforating of the casing string, the toolstring, including the fired perforating guns, are typically retrieved to the surface.

In some instances, the toolstring may become stuck deep within the wellbore before the toolstring has been retrieved to the surface, making the expensive and risky endeavor of creating a hydrocarbon producing wellbore significantly more expensive as completion of the wellbore is delayed for potentially weeks as operators attempt to retrieve the stuck toolstring. One circumstance where toolstrings may become stuck in a wellbore is in response to the violent detonation of the perforating guns of the toolstring. Particularly, the violence of the detonation may damage the perforating guns, making the guns vulnerable to becoming hung in a casing joint or other irregularity in the casing string.

As described above, while such perforating operations are often performed at the end of a wireline which is able to pull on stuck tools with considerable tension, it is not entirely uncommon for tools to become stuck deep within the wellbore such that the tension applicable by the wireline is insufficient for releasing the stuck toolstring. In such a scenario, the approach is typically to disconnect an uphole portion of the toolstring from the stuck tool and retrieve the uphole portion of the toolstring from the casing string leaving the stuck tool therein. Subsequently, it may be arranged for a fishing rig to visit the well site for either grabbing the stuck tools and wrestling them out of the wellbore (with substantially greater pulling force than that provided by the wireline) or for breaking the tools up within the wellbore such that the remains may be flushed from the casing string.

A particularly problematic scenario occurs when, in an attempt to extract the toolstring from the casing string, tension applied to the wireline results in the wireline failing or snapping such that an extended run of the wireline lies loosely on the stuck tool occupying hundreds of feet of the wellbore. To eliminate the risk of a snapped wireline, it is typical practice to include a ballistic release tool in the toolstring at an uphole end thereof that is appended to the end of the wireline. The ballistic release tool may be remotely triggered by an operator at the surface to disconnect the wireline from the toolstring. Although ballistic release tools are typically not activated on a given run into a wellbore, the insurance provided by the ballistic release tool is relied on and utilized by the operators of the toolstring as the toolstring is deployed through the wellbore, permitting the operators to complete the perforating operation as quickly as possible. Unfortunately, failures of ballistic release tools are not unknown either.

Particularly, there are generally three basic failures for ballistic release tools. First, the ballistic release tool must reliably carry electric signals and power from the wireline to the toolstring extending downhole from the release tool. Second, the ballistic release tool must not release unless it is given the appropriate signal from the surface. Third, the ballistic release tool must release the toolstring from the wireline when the appropriate signal is received by the release tool. All three failure types are typically driven by both (1) the substantial and recurring bending forces endured by the toolstring at the surface as the toolstring is hoisted from the ground up into the air above the wellbore prior to being inserted into the wellbore, and (2) the substantial and recurring tension endured by the toolstring when the toolstring is pulled uphole through the casing string after most or all of the perforating guns of the toolstring have been fired and physical contact between the remains of the fired perforating guns and the casing string results in the application of considerable frictional drag on the wireline.

What is needed and desired by the industry is a more robust and more reliable release tool that may be reused over and over with confidence.

SUMMARY OF THE DISCLOSURE

This disclosure more particularly relates to release tools for securing downhole tools to a workstring and optionally releasing the downhole tool in a wellbore extending through a subterranean earthen formation where the release tool includes a downhole housing and an uphole assembly. The downhole housing has an uphole end and a downhole end opposite the uphole end for connecting to the downhole tool. The uphole assembly includes an uphole housing with an uphole end and a downhole end. The uphole end of the uphole assembly couples to the workstring and the downhole end of the uphole assembly couples to the downhole housing. In some embodiments, the release tool includes a lock ring to secure the uphole housing to the downhole housing when in a locked state where the lock ring is pressed outwardly towards a locking groove prevented from deflecting inwardly. The lock ring additionally includes an unlocked state in which the lock ring is allowed to deflect inwardly away from the locking groove such that the uphole housing is permitted by the lock ring to disconnect from the downhole housing. Additionally, in some embodiments, the release tool includes a movable wedge having a first position to prevent the lock ring from deflecting inwardly and a second position that permits the lock ring to deflect inwardly. The movable wedge is movable from the first position to the second position while downhole. Further, in certain embodiments, the release tool includes a combustion element to propel the movable wedge from the first position to the second position thereby enabling the disconnect and release of the downhole housing from the uphole housing in response the uphole assembly receiving a release signal, such as a release signal communicated from the surface.

This disclosure also relates to a release tool for securing a downhole tool to a a workstring within a wellbore and optionally releasing the downhole tool in that wellbore. In some embodiments, the release tool includes an uphole housing and a downhole housing connected to the uphole housing when the release tool is in a locked-in state and disconnected from the uphole housing when the release tool is in an a separate unlocked state. In some embodiments, the release tool includes a moveable wedge attached to both the uphole housing and the downhole housing, and a lock ring disposed in the downhole housing. The lock ring has a locked state in which the lock ring is restricted from compression toward a reduced radius by the moveable wedge to lock the downhole housing to the uphole housing, and an unlocked state in which the lock ring may be compressed toward a reduced radius enabling the downhole housing to be released from the uphole housing. In certain embodiments, the release tool includes an actuation module configured to move the moveable wedge relative to the lock ring to permit a radius reduction of the lock ring thereby shifting the lock ring from the locked state to the unlocked state in response to receiving a release signal, such as a release signal communicated from the surface.

In another aspect of this disclosure, a release tool is provided for securing a downhole tool to a workstring system such as a wireline system within a wellbore and optionally releasing the downhole tool within the wellbore. In some embodiments, the release tool comprises an uphole housing and a downhole housing attached end-to-end by a lock ring (e.g., a c-ring) nested into an inner locking groove formed on the inside of one of or both of the uphole housing and the downhole housing. In certain embodiments, the release tool includes a load shoulder arranged to press against a lower end of the c-ring in response to the application of a tensile load on the uphole and downhole housings. In certain embodiments, the release tool includes a wedging device having a locked state that prevents the c-ring from lifting out of the inner locking groove and an unlocked state that permits the c-ring to rise out of the locking groove. In certain embodiments, the release tool includes a combustion element configured to transition the wedging device from the locked state to an unlocked state.

And in a further aspect, this disclosure relates to a release tool for securing a downhole tool to a workstring system such as a wireline system into a wellbore and optionally releasing the downhole tool in that wellbore where the release tool comprises an uphole housing and a downhole housing connected end-to-end with a low explosive combustion element configured to selectably disconnect the uphole and downhole housings from one another.

In an embodiment, a release tool is disclosed for releasably securing a workstring to a downhole tool deployable into a wellbore extending through a subterranean earthen formation. The release tool includes a downhole housing having a downhole end for connecting to the downhole tool and an uphole end opposite the downhole end, and an uphole assembly. The uphole assembly includes an uphole housing having an uphole end connectable to the workstring and a downhole end connectable to the downhole housing, and a lock ring configured to releasably secure the uphole housing to the downhole housing, wherein the lock ring has a locked state in which the lock ring is pressed outwardly towards a locking groove of the downhole housing whereby the lock ring is prevented from deflecting radially inwards, and an unlocked state in which the lock ring is allowed to deflect radially inwards away from the locking groove whereby the uphole housing may disconnect from the downhole housing. The uphole assembly additionally includes a movable wedge moveable between a first position preventing the lock ring from transitioning from the locked state to the unlocked state and a second position permitting the lock ring to transition from the locked state to the unlocked state, and a combustion element configured to propel the movable wedge from the first position to the second position to release the downhole housing from the uphole housing in response the release tool receiving a release signal.

In an embodiment, a release tool is disclosed for releasably securing a workstring to a downhole tool deployable into a wellbore extending through a subterranean earthen formation. The release tool includes an uphole housing connectable to the workstring, a downhole housing connected to the uphole housing when the release tool is in a locked state and disconnected from the uphole housing when the release tool is in a released state, and a moveable wedge coupled to the uphole housing and positioned in the downhole housing. The release tool additionally includes a lock ring disposed in the downhole housing and having a locked state in which the lock ring is restricted from radially contracting by the moveable wedge to lock the downhole housing to the uphole housing, and an unlocked state in which the lock ring is permitted to radially contract thereby permitting the downhole housing to be released from the uphole housing, and an actuation module configured to move, in response to receiving a release signal, the moveable wedge relative to the lock ring to transition the lock ring from the locked state to the unlocked state.

In an embodiment, a release tool is disclosed for releasably securing a workstring to a downhole tool deployable into a wellbore extending through a subterranean earthen formation. The release tool includes a downhole housing having an uphole end, and a downhole end connectable to the downhole tool, and an uphole assembly including an uphole housing having an uphole end connectable to the workstring and a downhole end connectable to the downhole housing, and a lock ring secured to the uphole housing and disposed within the downhole housing when the release tool is in a locked state, wherein the lock ring has a locked state in which the lock ring locks the uphole housing to the downhole housing, and an unlocked state in which the lock ring is unlocked from at least one of the uphole housing and the downhole housing such that the downhole housing is permitted to move relative to the uphole housing along a central axis of the release tool. In addition, the uphole assembly includes a piston having a first position that maintains the lock ring in the locked state and a second position that permits the lock ring to transition from the locked state to the unlocked state, and a combustion element configured to shift, in response to the uphole assembly receiving a release signal, the piston from the first position to the second position and thereby transition the release tool from the locked state to a released state in which the downhole housing is released from the uphole housing.

In an embodiment, a release tool is disclosed for releasably securing a workstring to a downhole tool deployable into a wellbore extending through a subterranean earthen formation. The release tool includes an uphole housing and a downhole housing, wherein the uphole housing is connected to the downhole housing in a locked state of the release tool, and the uphole housing is released from the downhole housing in a released state of the release tool, an inner locking groove formed on a radially inner surface of one of the uphole housing and the downhole housing with a lock ring nested into the inner locking groove, and a load shoulder configured to press against a downhole end of the lock ring in response to the application of tension against the uphole housing and the downhole housing. In addition, the release tool includes a wedge that, in a locked state, prevents the lock ring from escaping the inner locking groove and, in an unlocked state, permits the lock ring to escape from the locking groove, and a combustion element configured to transition the wedge from the locked state to the unlocked state.

In an embodiment, a release tool is disclosed for releasably securing a workstring to a downhole tool deployable into a wellbore extending through a subterranean earthen formation. The release tool includes an uphole housing and a downhole housing, wherein the uphole housing is connected to the downhole housing in a locked state of the release tool, and the uphole housing is released from the downhole housing in a released state of the release tool, and a low explosive combustion element configured to transition the release tool from the locked state to the released state in response to the release tool receiving a release signal.

In an embodiment, a release tool is disclosed for releasably securing a workstring to a downhole tool deployable into a wellbore extending through a subterranean earthen formation. The release tool includes a downhole housing having a downhole end for connecting to the downhole tool and an uphole end opposite the downhole end, and an uphole assembly including an uphole housing having an uphole end connectable to the workstring and a downhole end connectable to the downhole housing, and a lock ring configured to releasably secure the uphole housing to the downhole housing, wherein the lock ring has a locked state in which the lock ring is pressed outwardly towards a locking groove of the downhole housing whereby the lock ring is prevented from deflecting radially inwards, and an unlocked state in which the lock ring is allowed to deflect radially inwards away from the locking groove whereby the uphole housing may disconnect from the downhole housing. In addition, the uphole assembly includes a movable wedge moveable between a first position preventing the lock ring from transitioning from the locked state to the unlocked state and a second position permitting the lock ring to transition from the locked state to the unlocked state, and at least one push off lug axially translatable from a recessed position to an extended position, wherein an uphole face of the at least one push off lug faces a downhole face of the moveable wedge and a downhole face of the at least one push off lug faces the downhole housing such that the at least one push-off lug translates from the recessed position to the extended position as the moveable wedge translates from the first position to the second position whereby an axially directed downhole force is applied to the downhole housing by the downhole face of the at least one push off lug in the extended position. Further, the release tool includes a combustion element configured to propel the movable wedge from the first position to the second position to release the downhole housing from the uphole housing in response the release tool receiving a release signal.

BRIEF DESCRIPTION OF THE DRAWINGS

A more complete understanding of the present disclosure may be obtained from the following detailed description with reference to the attached drawing figures as summarized below, in which.

DETAILED DESCRIPTION

Figure 1:
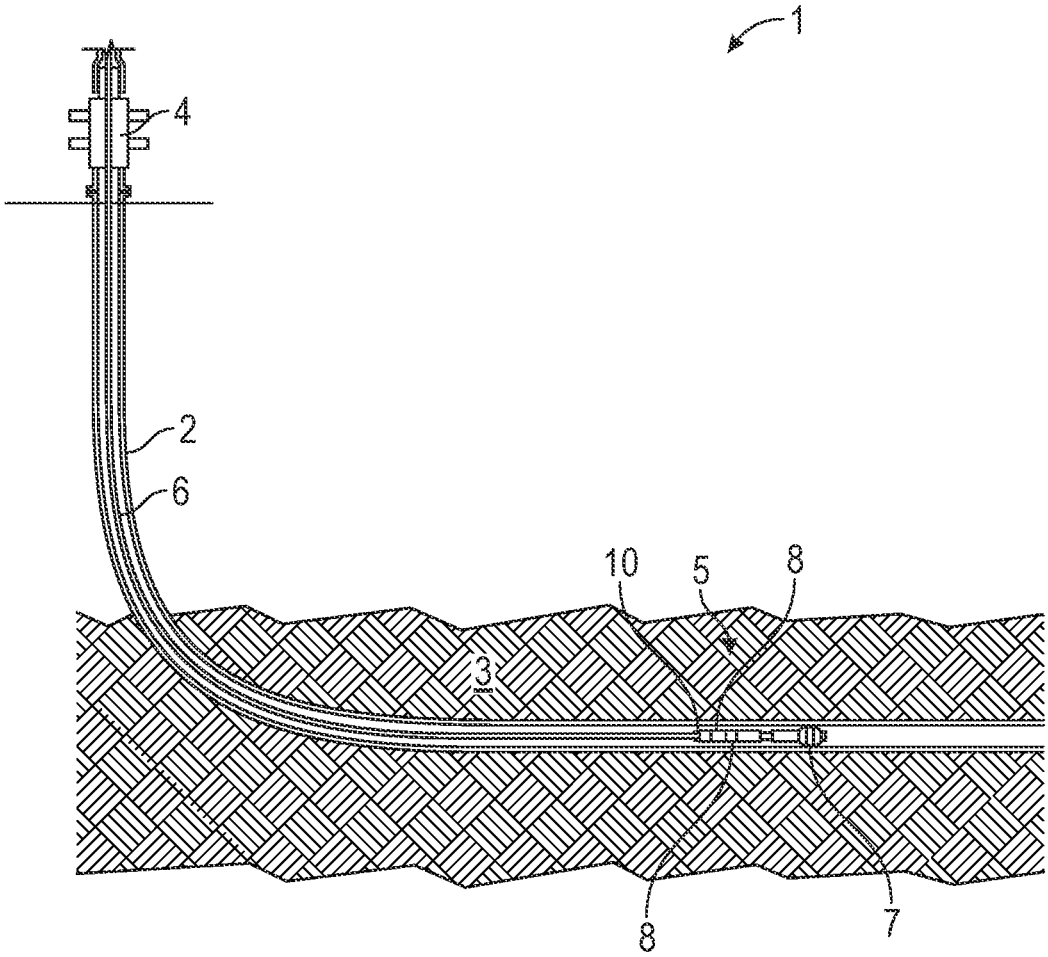
FIG. 1 is a schematic view of an embodiment of toolstring deployed into a wellbore penetrating a subterranean earthen formation.
Figure 2:
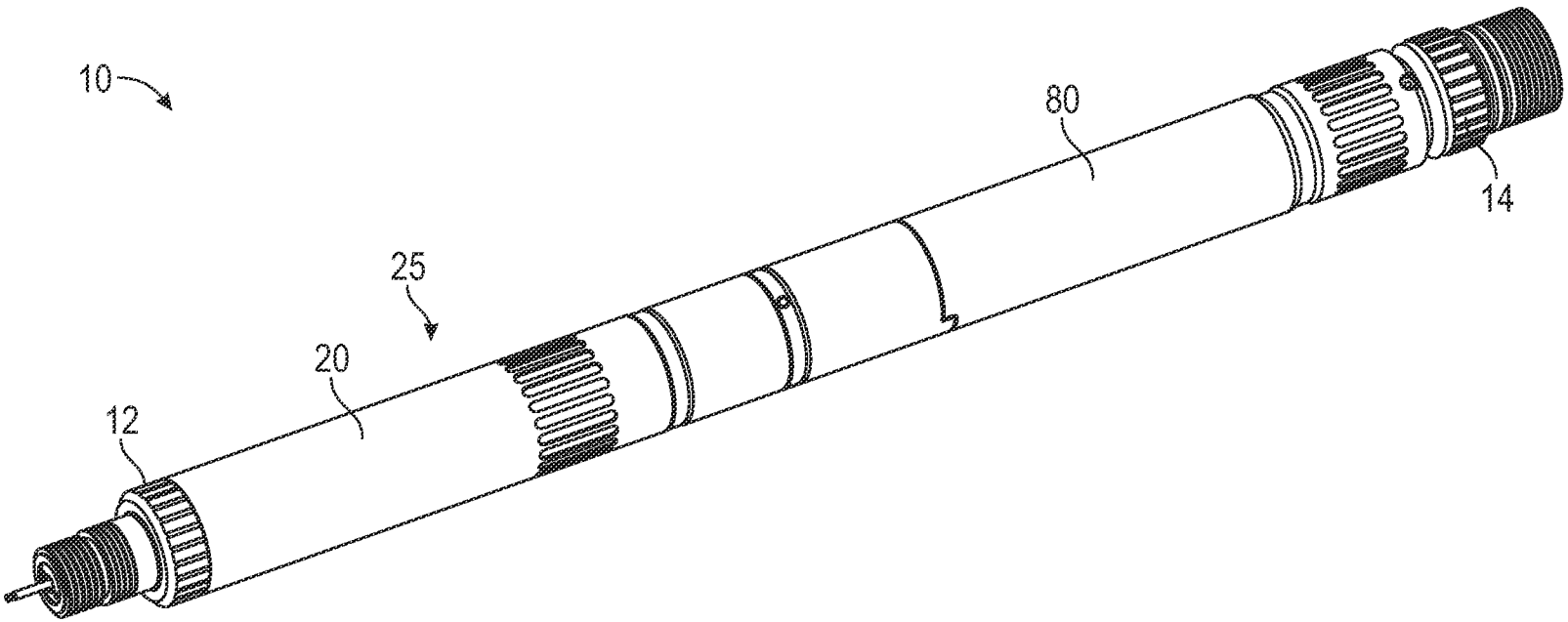
FIG. 2 is a perspective view of an embodiment of a release tool of the toolstring of FIG. 1.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Referring initially to FIG. 1, a workstring or wireline system 1 is shown for deploying a toolstring 5 into a cased wellbore 2 for performing a perforating operation such as, for example, a plug and perforating ("plug-and-perf") operation. While embodiments of release tools described herein may typically be used in conjunction with wireline systems (e.g., wireline system 1) as part of a plug-and-perf operation, it may be understood that release tools described herein may be quite useful with most any type of downhole workstring system including, for example, coiled tubing, a threaded tubular string comprising a plurality of tubular joints connected end-to-end, a threaded rod string, and other conceivable systems useful for conducting work downhole within a wellbore and with whatever downhole tools may be used for the establishment of a hydrocarbon producing wellbore or maintenance or repair of the same.

As described above, wellbore 2 comprises a cased wellbore in which casing (commonly called a casing string) is installed. Cased wellbore 2 extends from the surface far into the Earth and into an extended generally horizontal run within a hydrocarbon bearing formation 3 deep in the ground. It may be understood that prior to inserting toolstring 5 into cased wellbore 2, a crane (not shown in FIG. 1) positioned adjacent the cased wellbore 2 may be utilized for vertically lifting the toolstring 5 above a surface assembly 4 (only partially shown in FIG. 1 and including, e.g., a wellhead, a valve tree) whereby toolstring 5 may be vertically lowered and run through the surface assembly 4 such that toolstring 5 may be inserted into the cased wellbore 2.

The toolstring 5 of wireline system 1 includes a number of tools that are selected by an operator of the cased wellbore 2 for facilitating the performance of the plug-and-perf operation. In this exemplary embodiment, toolstring 5 includes, among other components, a plug 7 at a downhole end thereof, one or more perforating guns 8 positioned uphole from the plug 7, and a release tool 10 located at an uphole end thereof. It may be understood that toolstring 5 may include additional components such as, for example, tools for providing pressure isolation and/or electrical communication across the toolstring 5, as well as a setting tool for setting the plug 7 within the cased wellbore 2 (e.g., actuating the plug 7 from a run-in configuration to a set configuration in which the plug 7 sealingly anchors to the cased wellbore 2).

As will be described further herein, release tool 10 of toolstring 5 attaches to a workstring or wireline 6. Particularly, the wireline 6 extends from a wireline truck of the surface assembly 4, and is typically quite long to permit the toolstring 5 to run potentially miles down into and through the cased wellbore 2. It may be generally understood that wellbores, including cased wellbore 2, extend vertically downwards from the surface along a vertical section thereof and then curve towards a generally horizontal path or section that is typically a great length (e.g., a mile or more) horizontally through a hydrocarbon bearing zone (e.g., formation 3 shown in FIG. 1).

As shown in FIG. 1, toolstring 5 is lowered and typically pumped downhole through the cased wellbore 2 to a generally horizontal section thereof where the wellbore 2 extends a significant distance along within a hydrocarbon bearing formation 3. At a desired location in the cased wellbore 2, the plug 7 of toolstring 5 is set or deployed to both seal and anchor against the inside of the casing (not shown in FIG. 1) to isolate an uphole portion of the cased wellbore 2 (the portion of cased wellbore 2 extending uphole from the set plug 7) from a downhole portion (the portion of cased wellbore 2 extending downhole from the set plug 7) of cased wellbore 2. The plug 7, once set, prevents fluid that will be pumped downhole from surface assembly 4 intended to frack newly created perforations in the cased wellbore 2 from escaping downhole past the set plug 7 and into previously formed perforations and preventing the needed build in fluid pressure to frack the newly created perforations. It may be understood that significant hydraulic pressure is required to enlarge and extend new perforations so plug-and-perf operations typically begin bt plugging off the downhole existing perforations (e.g., previously fracked perforations), separating the set plug 7 from the remainder of the toolstring 5 so that new perforations may be created in the cased wellbore 2 uphole from the set plug 7. Once the plug 7 is disconnected from toolstring 5, the toolstring 5 may lay on a vertical bottom (relative to the direction of gravity) of the horizontal section of the cased wellbore 2. With the toolstring 5 located on the vertical bottom of the cased wellbore 2, toolstring 5 may be pulled uphole toward the surface while each of a number of perforating guns 8 of toolstring detonated at predetermined positions to shoot or discharge shaped explosive charges puncturing the cased wellbore 2 (e.g., perforations formed in the casing of the cased wellbore 2) thereby creating a new perforation therein.

As described above, in some instances the toolstring 5 may become stuck in the cased wellbore 2 before being retrieved to the surface. For example, the remains of the fired perforating guns 8, still attached to the toolstring 5, may catch against or hang onto a casing joint positioned along the cased wellbore 2. As just one example, a piece of shrapnel of one of the fired perforating guns 8 may catch into a groove formed in a casing joint of the casing of the cased wellbore 2, causing the remains of the fired perforating gun 8 to become stuck against the casing joint thereby preventing further uphole travel of the now stuck toolstring 5. While it is generally preferable to retrieve toolstring 5 intact from the cased wellbore 2, in at least some instances, it may be necessary to activate the release tool to separate the toolstring 5 from the wireline 6, permitting the wireline 6 to be conveniently and quickly retrieved to the surface without the stuck toolstring 5. Later, at least a portion of the stuck toolstring 5 may be drilled out or otherwise broken up into flow-transportable debris that may be washed or flushed from the cased wellbore 2 (e.g., returned to the surface assembly 4). In this manner, operators of wireline system 1 may avoid the undesirable need of calling in a fishing rig in an attempt to fish the stuck toolstring 5 (along with the severed portion of the wireline 6) from the cased wellbore 2, an unpredictable process which may take days or weeks before the stuck toolstring 5 may be successfully retrieved from the cased wellbore 2. The extended downtime caused by the stuck toolstring may substantially increase the overall costs associated with placing the cased wellbore 2 into production.

Turning now to FIGS. 2-6, an embodiment of the release tool 10 is shown. As described above, the release tool 10 may be used in wireline-deployed toolstrings such as a plug and perf toolstrings (e.g., the toolstring 5 shown in FIG. 1) that are run downhole deep into a wellbore (e.g., cased wellbore 2 shown in FIG. 1) where the possibility exists of the toolstring becoming stuck (e.g., irretrievable via a wireline connected therewith) in the wellbore. In this exemplary embodiment, release tool 10 generally includes a first or uphole housing 20 coupled end-to-end to a second or downhole housing 80. As will be described further herein, release tool 10 has a locked state in which the uphole housing 20 is connected to the downhole housing 80 and a released state in which the downhole housing 80 is disconnected from the uphole housing 20 such that the uphole housing 20 may be separated from the downhole housing 80 (e.g., retrieved to the surface leaving the downhole housing 80 within the wellbore).

In addition to housings 20 and 80, release tool 10 includes a top sub 12 coupled (e.g., screwed into) to the uphole end of the uphole housing 20. The uphole end of top sub 12 is configured for connecting to a wireline (e.g. wireline 6 shown in FIG. 1) or other deployment tool. Further, release tool 10 includes a bottom sub 14 coupled (e.g., screwed into) to the downhole end of the downhole housing 80 for connecting to the bulk of the toolstring, especially the portion of the toolstring including the perforating guns (e.g., perforating guns 8 shown in FIG. 1) which are subject to substantial damage and deformation in response to their firing within the wellbore. If the toolstring becomes irretrievably (e.g., via the wireline or other deployment tool) stuck in the wellbore, the release tool 10 may be activated to separate the uphole housing 20 from the downhole housing 80 (e.g., transition release tool 10 from the locked state to the released state) where the downhole housing 80 may be left with the bulk of the toolstring in the wellbore.

In this exemplary embodiment, many of the internal components and operating elements of the release tool 10 reside within and stay with (e.g., are not separated from) the uphole housing 20 following the transition of release tool 10 to the released state. In this way, the bulk of release tool 10 may be successfully retrieved to the surface by the wireline (or other deployment tool) along with the uphole housing 20 instead of remaining in the wellbore with the remainder of the toolstring. As such, the uphole housing 20 comprises a component of an integrated uphole assembly indicated by arrow 25 in FIG. 3.

In the present disclosure, embodiments of release tools disclosed herein, including the release tool 10, are powered by an energetic element that may generally be characterized as a low explosive producing high pressure combustion gasses configured to drive and move a locking mechanism of the release tool 10 from a locked state to an unlocked state. In comparison, prior art ballistic release tools typically detonate high explosive energetics to explosively break apart one or more components of a locking mechanism of the conventional release tool. The detonation of a high explosive produces particularly destructive power generally characterized by a shock wave driven by the high velocity propagation of a detonation front of the explosion exceeding the speed of sound. In such conventional ballistic release tools, the destructive power of a high explosive is intended to break apart ballistically some critical connective structure of the conventional release tool to transition ballistically the conventional release tool to a released state. In comparison, embodiments of release tools disclosed herein, including release tool 10, are designed not for ballistic destruction via a shockwave, but for disconnection via fluidic pressure. Particularly, embodiments of release tools disclosed herein utilize high pressure gas as a medium to drive the locking mechanism which, since it is not sacrificial as with the locking mechanisms of conventional ballistic release tools (which are intentionally destroyed by the detonation of a high explosive) and may thus be designed robustly such that at least an uphole assembly thereof (e.g., uphole assembly 25) may be reused for a considerable number of deployments into multiple wellbores.

Figure 3:
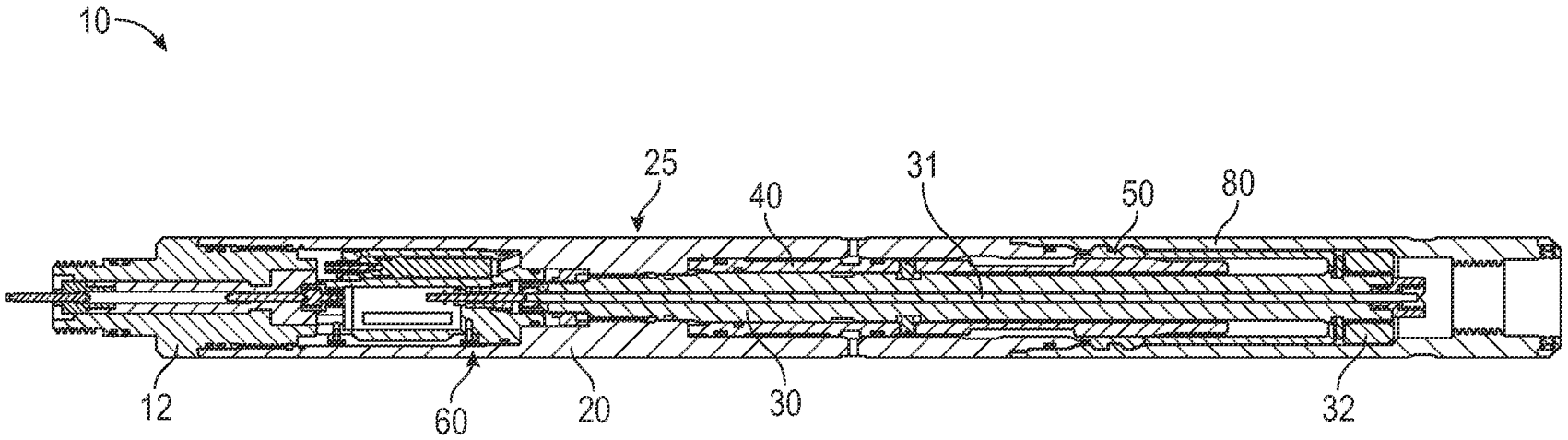
FIG. 3 is an elevation cross-section view of the release tool of the present disclosure.

Providing an overview of the operating elements of release tool 10, and as shown particularly in FIG. 3, a top or uphole end of the uphole housing 20 accommodates an actuation module 60 of release tool 10 that is located just below the top sub 12. Coupled or screwed into the uphole housing 20 below the actuation module 60 is a mandrel 30 of the release tool 10 which extends in a downhole direction from the uphole housing 20 and into the downhole housing 80. In this exemplary embodiment, mandrel 30 includes an axially extending passage with an electric communication bar 31 of the release tool 10 disposed centrally therein for carrying electrical power and/or signals between the wireline connected to the uphole end of release tool 10 and the toolstring coupled to the downhole end of release tool 10.

In this exemplary embodiment, a bottom collar or catch sleeve 32 of release tool is coupled or screwed onto a radially outer surface of mandrel 30 at a downhole end thereof, thereby substantially filling the inner diameter of the downhole housing 80. Additionally, a tubular piston 40 of release tool 10 is configured to be carried on the radially outer surface of the mandrel 30 and which is configured to seal against the radially outer surface of the mandrel 30 along with the a radially inner surface (e.g., defining the inner diameter of uphole housing 20) of the uphole housing 20. However, the tubular piston 40 is also free to slide or translate axially (albeit with considerable frictional resistance) with respect to both the uphole housing 20 and mandrel 30. Securing the upper assembly 25 to the downhole housing 80 is a locking mechanism or ring 50 of release tool 10 having peripheral (radially outer) circumferential ridges or dogs 55 (indicated in FIG. 7) configured to press or settle into a corresponding circumferential inner locking groove 85 formed along a radially inner surface (e.g., defining an inner diameter of the downhole housing 80) of the downhole housing 80 (two grooves are shown, but a profile including a single groove or multiple grooves are within the scope of the present disclosure) when the lock ring 50 is in a locked state. Once received in the inner locking groove 85 of downhole housing 80, the circumferential ridges 55 of lock ring 50 are held within the inner locking groove 85 by a wedging action of a moveable wedge 41 of the release tool 10 positioned along the periphery or radially outer surface of tubular piston 40.

Figure 4:
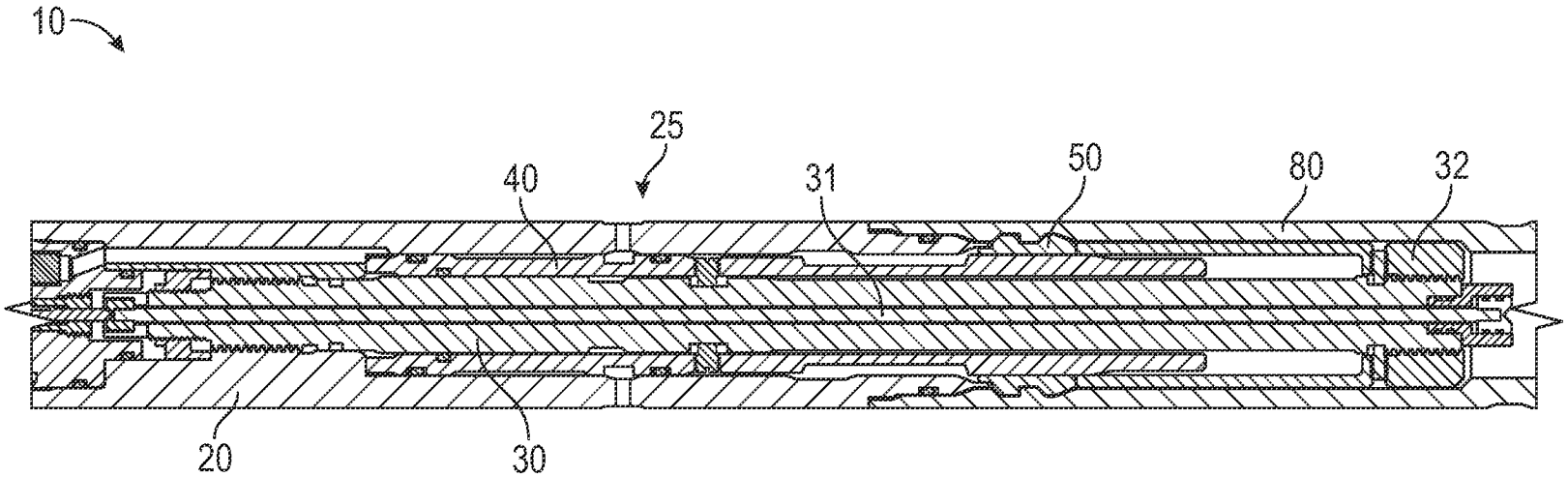
FIG. 4 is an enlarged, fragmentary elevation cross-sectional view of the release tool of the present disclosure.

As shown particularly in FIG. 4, in this exemplary embodiment, the mandrel is coupled or screwed into the uphole housing 20 at a location where uphole housing 20 has a relatively greater radial wall thickness. Similarly, in this exemplary embodiment, the mandrel 30 is coupled or screwed into a bulky section of the catch sleeve 32 having an enlarged radial thickness. The shape of catch sleeve 32 accommodates the tubular piston whereby the piston 40 is permitted to move axially downhole a considerable length thereof while also having a ring or load shoulder 33 at an uphole end thereof positioned a similar distance back uphole toward the uphole housing 20 and located proximal the downhole end of the lock ring 50. In this exemplary embodiment, the load shoulder 33 of catch sleeve 32 has a blunt configuration to press against the lock ring 50 to dislodge the same from the circumferential inner locking groove 85 of the downhole housing 80 as release tool 10 transitions from the locked state to the released state. In this manner, catch sleeve 32 may carry the lock ring 50 back to the surface following the separation of release tool 10.

Figure 5:
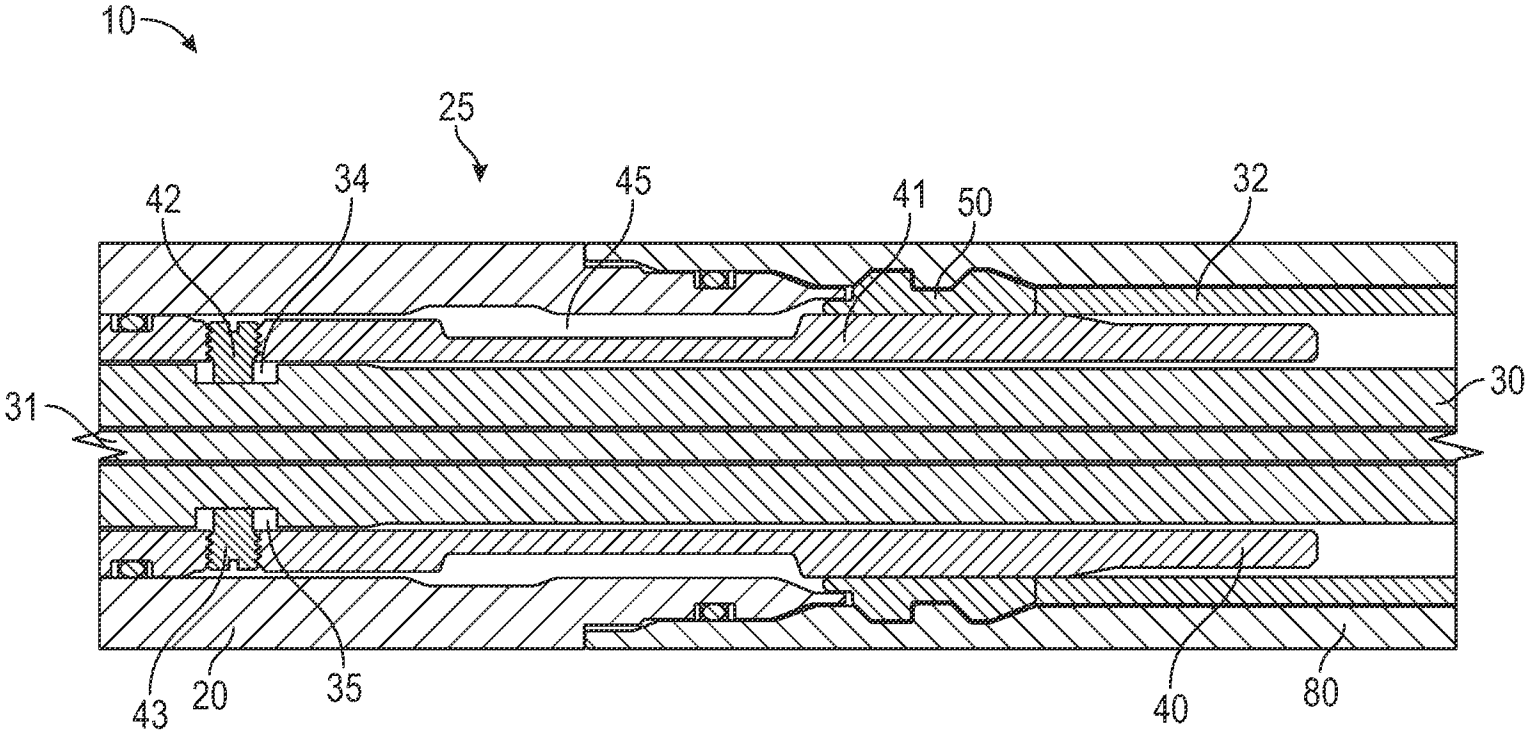
FIG. 5 is a further enlarged, fragmentary elevation cross-sectional view of the release tool focusing on the locking arrangement in its locked state.
Figure 6:
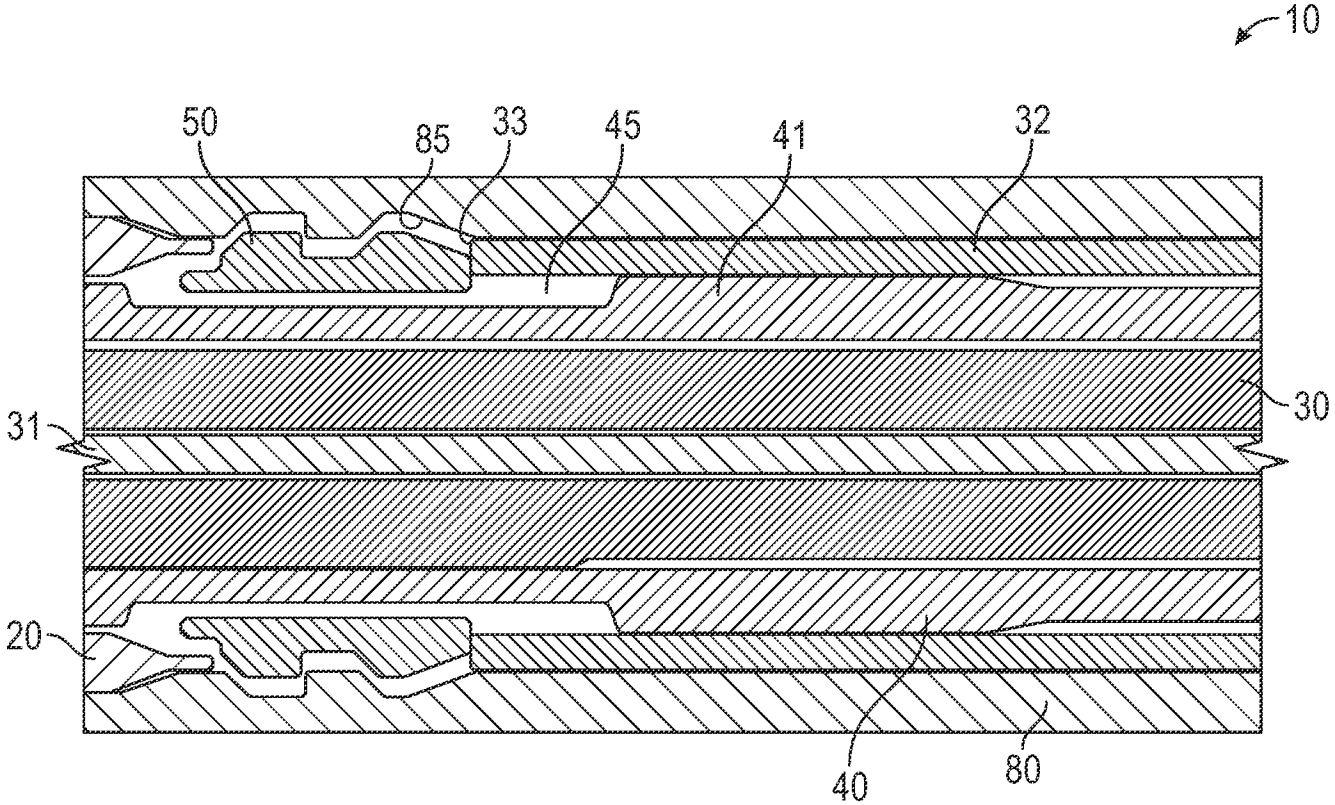
FIG. 6 is an additional enlarged, fragmentary elevation cross-sectional view of the release tool similar to FIG. 5, but showing the locking arrangement in the unlocked state.

As shown particularly in FIGS. 5 and 6, to explain how the lock ring 50 is supported for locking the mandrel 30 to the downhole housing 80, it should be understood that the volume of the downhole housing 80 within the lock ring 50 is substantially occupied by the mandrel 30, electric communication bar 31 and tubular piston 40 as shown in FIG. 5. In this configuration (corresponding to the locked state of release tool 10), there is no available space for the lock ring 50 to deform and slip from the circumferential inner locking groove 85.

In comparison, FIG. 6 shows the tubular piston 40 displaced further (to the right in FIG. 6) into the downhole housing 80 whereby a circumferential relief groove 45 formed on the periphery of the tubular piston 40 is positioned radially between inner dimension of the lock ring 50 and the mandrel 30 creating an annular void space (the movable wedge 41 being axially offset from lock ring 50 in this arrangement) for the lock ring 50 to flex into or settle in as the load shoulder 33 of catch sleeve 32 presses the lock ring 50 uphole and out of the downhole housing 80. In this exemplary embodiment, frangible shear members or screws 42 and 43 of release tool 10 (which hold tool 10 in the locked state until it is desired to transition tool 10 to the released state) are shown having been sheared in the process of the tubular piston 40 moving axially downhole into the downhole housing 80. The circumferential inner locking groove 85 may have a sloped or inclined surface in the upward or uphole direction that serves, along with an appropriate ridge profile on the outer periphery of the lock ring 50, as a ramp-like profile to press the lock ring 50 into a compressed form (shown in FIG. 9) as it is pressed out of the inner locking groove 85. And although the lock ring 50 is shown to have a reduced diameter, it may be preferred in some instances for the lock ring 50 to have a resting or unstressed configuration (shown in FIG. 8) such that the ridge profile tends to press outwardly and fully into the inner locking groove 85 for ease of assembly and for reducing friction against the tubular piston 40.

Figure 7:
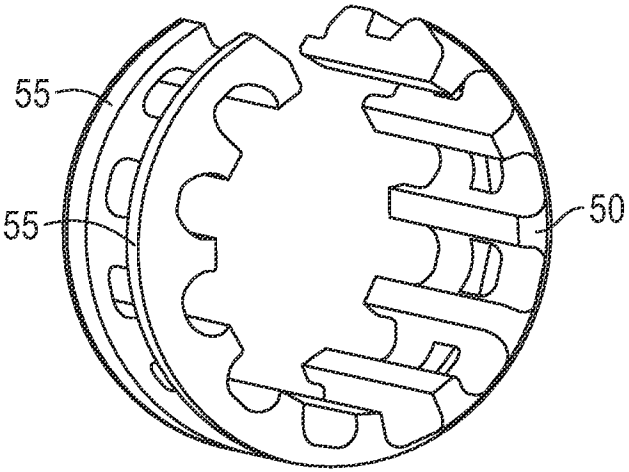
FIG. 7 is a perspective view of the lock ring of the present disclosure.
Figure 9:
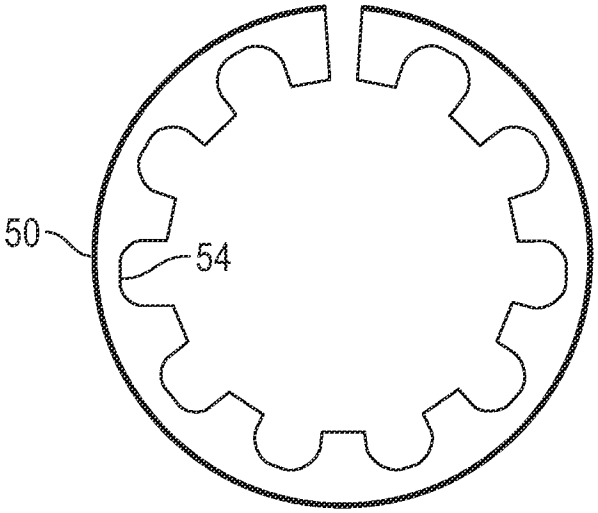
FIG. 9 is an end view of the lock ring of the present disclosure in its flexed condition in a smaller diameter configuration.
Figure 8:
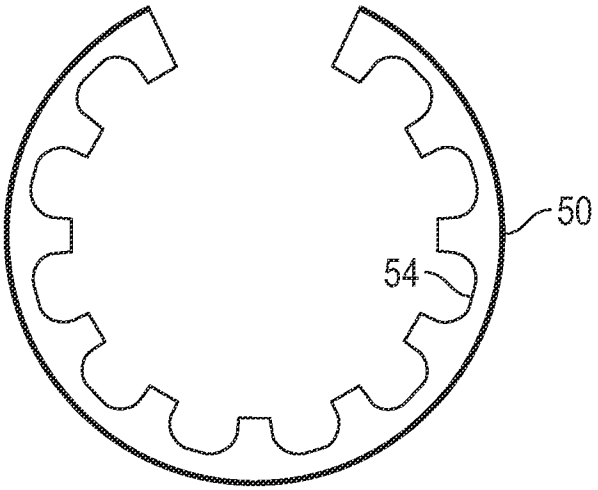
FIG. 8 is an end view of the lock ring of the present disclosure in its unflexed condition.

Referring to FIGS. 7-9, details of the lock ring 50 are shown. It may be noted that in this exemplary embodiment, lock ring 50 includes the circumferential ridges 55 formed along a radially inner surface or diameter of lock ring 50 and which are designed to lock into the two corresponding circumferential inner locking grooves 85 with an inclined slope that enables the lock ring 50 to slide out of the circumferential inner locking groove 85 when under an axial load imposed by the load shoulder 33. The lock ring 50 is also shown in FIGS. 7-9 to have a "C" shape in this exemplary embodiment (e.g., lock ring 50 comprises a C-ring in this exemplary embodiment). Particularly, in FIG. 8, lock ring 50 is shown is in an expanded state with a notable gap between the opposed ends of the "C". Lock ring 50 is shown in a contracted state in FIG. 9 in which lock ring 50 is released from the circumferential inner locking groove 85. It may be observed that an outer diameter of the lock ring 50 is greater when in the expanded state than when in the contracted state such that opposed arcuate ends of lock ring 50 are positioned closer together when the lock ring 50 is in the contracted state, the state lock ring 50 takes when being pressed out of the circumferential inner locking groove 85 in the outer housing 80. Additionally, in this exemplary embodiment, stress cuts 54 are arranged along the radially inner surface of lock ring 50 to lead lock ring 50 to maintain a more circular shape as it expands and contracts in diameter. In at least some applications, it is desired that the lock ring 50 not develop stress concentrations along its circumference making it deform in a less of a uniformly circular configuration and bend more in a "V" shaped configuration.

Figure 10:
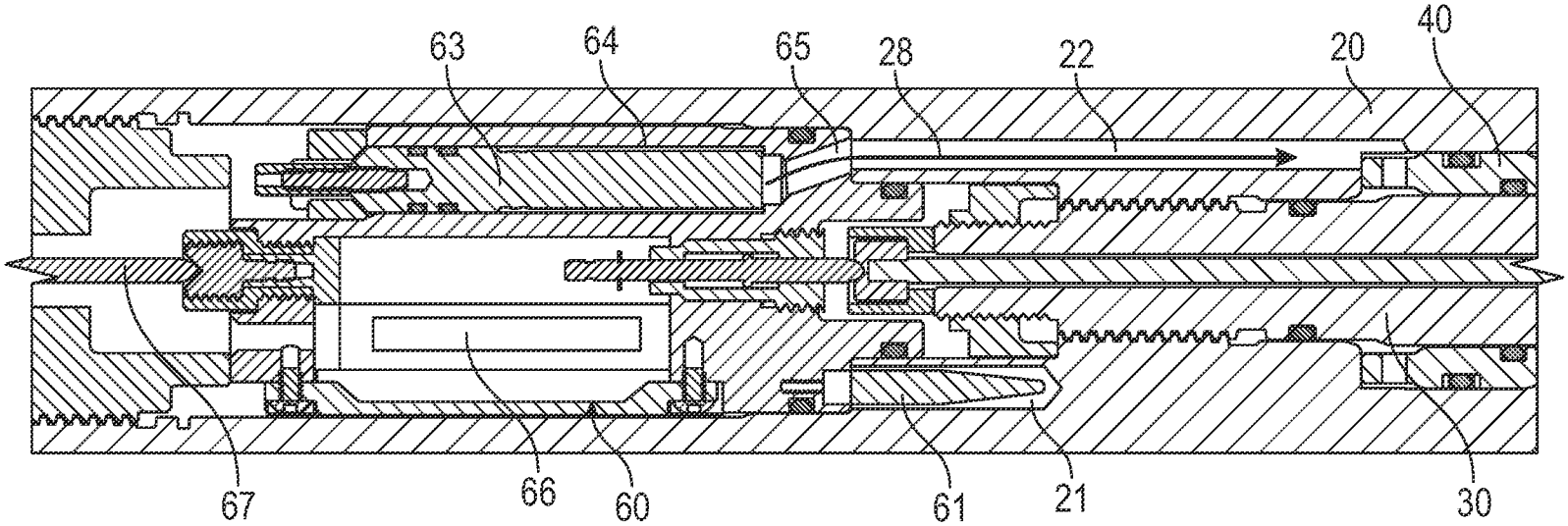
FIG. 10 is an enlarged, fragmentary elevation cross-sectional view of the release tool of the present disclosure showing the flow path of the combustion products to the slide piston in the unstroked configuration.

Turning now to FIG. 10, it is noted that the release tool 10 is generally configured to be deployed many times into one or more subterranean wellbores before ever needing to be activated (e.g., transitioned from the locked state to the released state) t in order to leave a stuck toolstring (e.g., toolstring 5) in a wellbore. Thus, the mechanical components of the release tool 10 are generally engineered to withstand a great number of deployment cycles in which tension is applied to the release tool 10 (e.g., from wireline 6) resulting from mangled perforating guns being dragged uphole through the cased wellbore 2. However, the electrical and combustible elements of release tool 10 are generally not as reliable as the mechanical components and thus may not be as trustworthy over a similarly great number of deployment cycles. As such, the electrical and combustible elements of release tool 10 may, in some applications, be routinely inspected, redressed, and/or replaced. To make this convenient and simple for such inspection and redressing, access to the electrical and combustible components of release tool 10 is provided to an operator of the release tool 10 at the top or uphole end of the release tool 10 just under the top sub 12. It is likely that such inspections and any redressing may be done in the field by personnel that may only open a respective release tool 10 a few times per year rather than in a manufacturing setting where such personnel would open many such devices as part of their daily routine. So, in comparison, release tool 10 is generally configured such that access to the electrical and combustible components thereof is generally more convenient compared to accessing and disassembling the mechanical (e.g., the locking and releasing components such as, for example, lock ring 50) components of the release tool 10.

Figure 15:
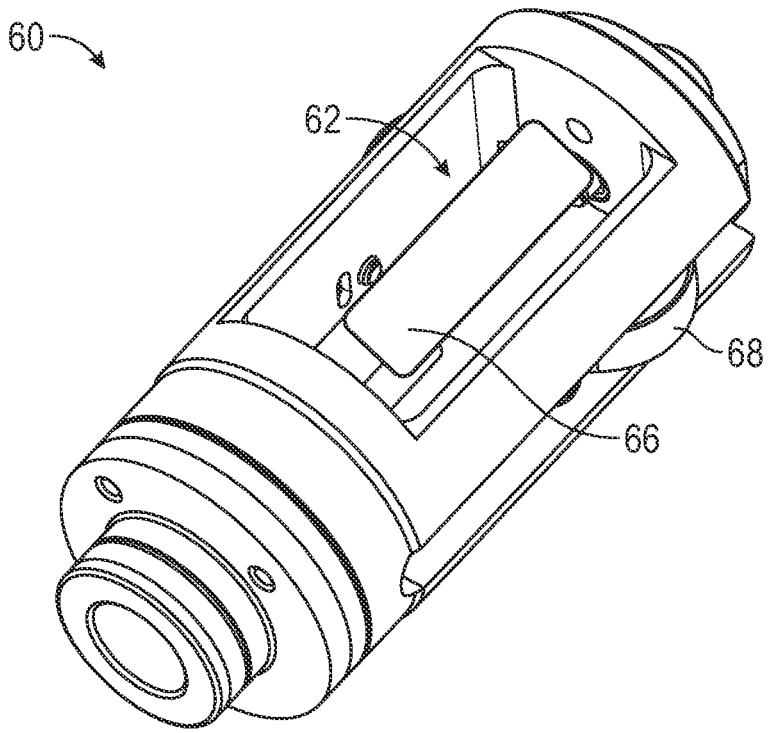
FIG. 15 is a perspective view of the actuation module in the uphole assembly of the release tool showing the open switch compartment.
Figure 16:
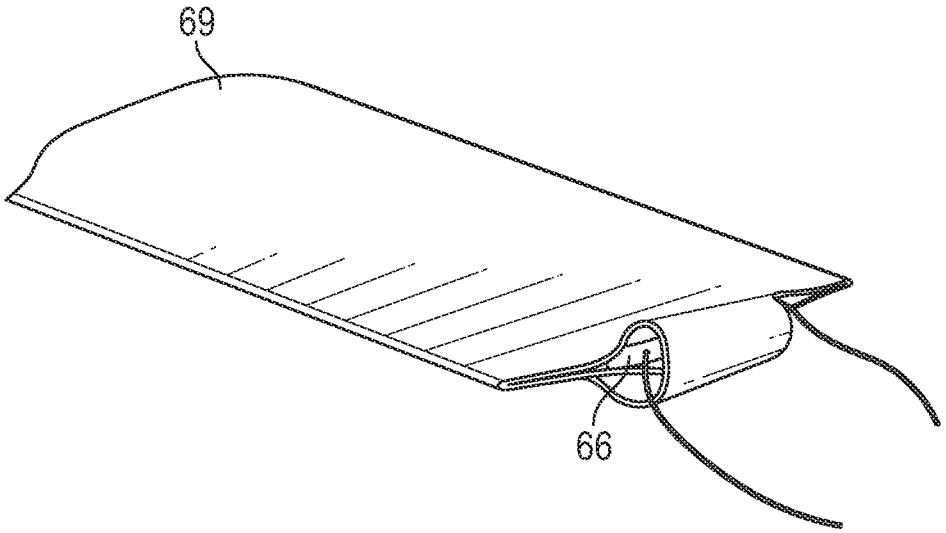
FIG. 16 is a perspective view of a first embodiment of a thermal insulation pouch for holding and protecting a switch used in the actuation module for receiving a release signal and powering the actuating elements of the release tool of the present disclosure.

Referring collectively to FIGS. 10, 15 and 16, the electrical and combustible components of release tool 10 are carried in an actuation module 60 of the release tool 10 in this exemplary embodiment that is sized and fitted to be disposed within the open, uphole end of the uphole housing 20 in one orientation, primarily due to an orienting pin 61 projecting off-axis from the downhole end of the actuation module 60. When properly oriented, the orienting pin 61 slips into a corresponding alignment pocket 21 formed in the uphole housing 20. Unless the orienting pin 61 is received down into the alignment pocket 21, the actuation module 60 will not settle fully into its position for the top sub 12 to be screwed to the uphole housing 20.

Actuation module 60 is generally configured to actuate the release tool 10 from the locked state to the released state in response to the actuation module 60 receiving a predefined release signal, such as a release signal communicated from the surface assembly 4 (e.g., via a signal generator of the surface assembly 4) via wireline 6. Particularly, actuation module 60 is configured to displace axially the movable wedge 41 of the piston 40 in response to receiving the release signal whereby the lock ring 50 of release tool 10 is permitted to deflect or compress itself from the locked state (in which lock ring 50 is secured to the downhole housing 80) to the unlocked state in which the uphole housing 20 may be pulled axially by the wireline 6 from the stuck downhole housing 80 and separated from the toolstring 5.

In FIG. 15, a switch compartment 62 of actuation module 60 is shown for receiving an electronic switch 66 (e.g., a digitally addressable electronic switch) which is electrically connected to an electric contact pin 67 (shown in FIG. 10). In this exemplary embodiment, the circuit formed from electronic switch 66 and contact pin 67 is completed by a radially oriented ground spring 68 of the actuation module 60. Switch 66 may be a digital switch including one or more processors, memory devices, and input/output (I/O) devices. Alternatively, switch 66 may be an analog electronic switch. Switch 66 is connected to equipment at the surface (e.g., a surface controller of surface assembly 4) through a circuit including wireline 6 and is further connected to an energetic or combustion element 63 of the actuation module 60 in a manner that initiates combustion of a combustible portion of combustion element 63 and thereby begins the process of separating the uphole and downhole housings 20 and 80 via the fluid pressure generated by the ignited combustion element 63. Particularly, combustion element 63 is configured to generate sufficient fluid pressure (e.g., from pressurized gas emitted by combustion element 63 following ignition) to transition release tool 10 from the locked state to the without needing to ballistically break apart the lock ring 50 (e.g., via the propagation of a shockwave).

Figure 17:
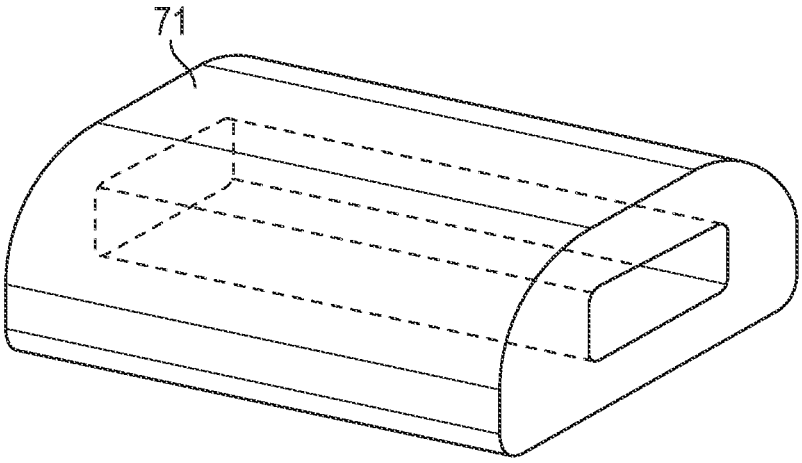
FIG. 17 is a perspective view of a second embodiment of a thermal insulation pouch for holding and protecting a switch used in the actuation module for receiving a release signal and powering the actuating elements of the release tool of the present disclosure.
Figure 18:
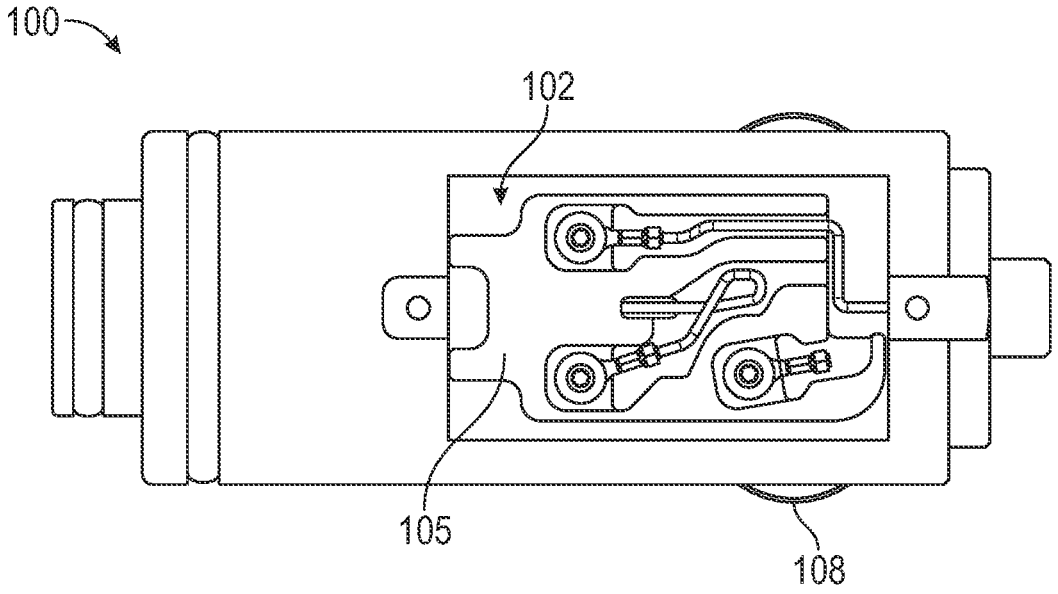
FIG. 18 is a top view of an additional embodiment of the actuation module.
Figure 19:
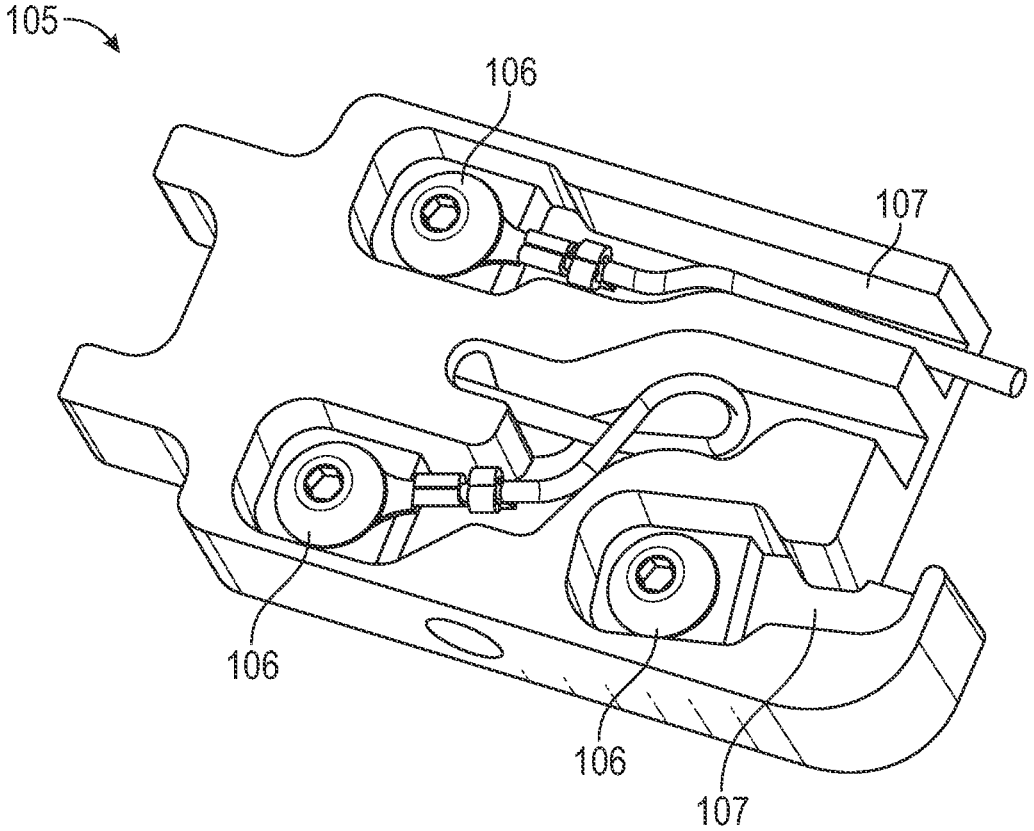
FIG. 19 is a perspective view of a wiring chassis of the additional embodiment in FIG. 18 used within the actuation module.

In this exemplary embodiment, switch 66 is insulated within the switch compartment 62 from the heat present in the downhole environment to reduce thermal degradation of the switch 66 noting that it is expected for the switch 66 to be exposed to a number of thermal cycles over many deployment cycles of release tool 10 in one or more separate wellbores. Referring to FIGS. 16 and 17, switch 66 is insulated by a pocket, pouch, cozy or other arrangement. Specifically, in the embodiment shown in FIG. 16, the switch 66 is slipped into a pouch 69 prior to installation in the actuation module 60. In an alternative embodiment shown in FIG. 17, a shaped insulation pouch 71 of actuation module 60 includes a pocket for the switch to be inserted. The exemplary insulation pouches 69 and 71 shown in FIGS. 16 and 17, respectively, are made of a thermally insulating material and may comprise a multi-layer insulating material which may be rigid but preferably pliable to better fit into the compartment 62 for the cover to set down securely for insertion of the module 60 into the top end of the uphole housing 20.

Referring again to FIGS. 10 and 11, in this exemplary embodiment, combustion element 63, as generally described above, comprises a low or low-order explosive (LE) (e.g., black powder and/or other materials) configured, in response to ignition resulting from the actuation module 60 receiving an appropriate release signal, to produce combustion gasses which acts as a propellant for applying an axially directed pressure force against the piston 40. Generally, the LE comprising combustion element 63 is not configured to produce a shockwave in response to ignition. In contrast, a high-order explosive (HE) often used in conventional release tools is characterized as producing a shockwave in response to detonation which would likely damage, destroy, or otherwise jeopardize the physical integrity and reliability of the upper housing 20 in which the actuation module 60 is positioned. However, the release tool 10 relies on the fluid (e.g., gaseous) pressure generated by the ignition of combustion element 63 to drive or propel, in a controlled manner (e.g., without destroying the internal components of release tool 10), the axial displacement of the piston 40 through the downhole housing 80 to initiate the release of the downhole housing 80 from the upper assembly 25. In other embodiments, combustion element 63 may comprise other types of materials configured to selectably generate fluid pressure without also generating a shockwave which may jeopardize the physical integrity of upper assembly 25. For example, in other embodiments, combustion element 63 may comprise pressurized gas contained within a sealed chamber that is selectably released to apply an axially directed pressure force against the piston 40. Additionally, in some embodiments, combustion element 63 comprises a unitized ignitor and power cartridge.

It should be understood that an initiator may be useful as part of a combustion process or low explosive akin to a propellant to create a fluidic (e.g., gaseous) actuating force as compared to destruction explosive force associated with a detonator or with detonation associated with a high explosive. In this exemplary embodiment, the combustion element 63 is in a combustion compartment 64 of actuation module 60 opposite from the switch compartment 62 and aligned to vent combustion gasses along a module flowpath (indicated by arrow 65 in FIGS. 10 and 11) formed in the actuation module 60. The combustion gasses produced by combustion element 63, once vented from the actuation module 60 along module flowpath 65, continue travelling through a housing flowpath 22 in fluid communication with module flowpath 65 and which extends through the uphole housing 20.

Figure 13:
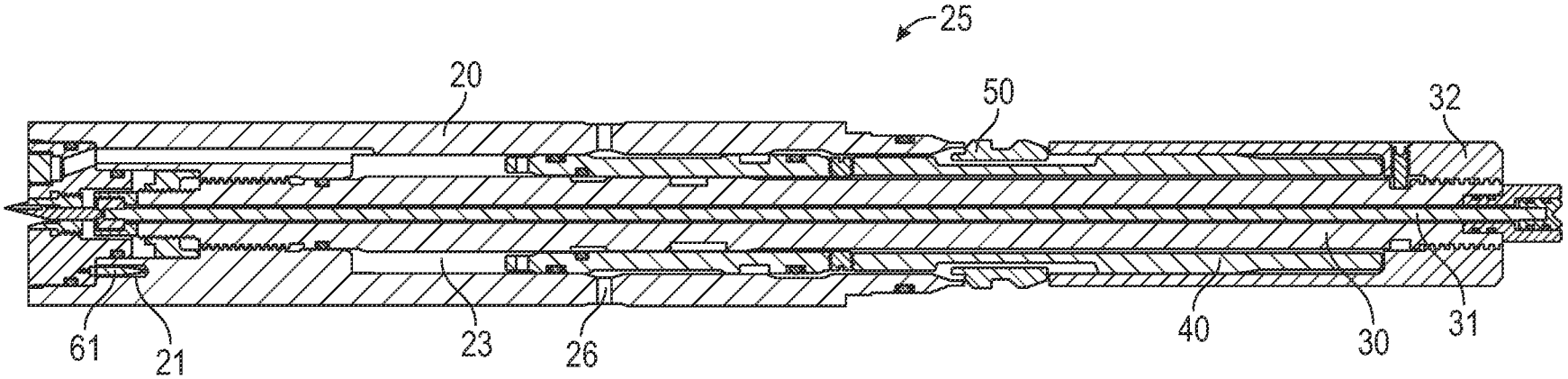
FIG. 13 is a cross-section view of the uphole assembly of the release tool released and free from the downhole housing.

In this exemplary embodiment, the combustion element 63, the module flowpath 65 and the housing flowpath 22 are aligned with the uphole end of the tubular piston 40 such that flowpaths 65 and 22 collectively form a combustion flowpath 28 for conveying combustion gasses created by initiating of the combustion element 63 to flow to drive the tubular piston 40 downwardly. In other words, combustion gasses are permitted to travel along housing flowpath 22, thereby encountering the uphole end of tubular piston 40 whereby the combustion gasses may apply a downhole axially directed pressure force against the uphole end of tubular piston 40. Referring to FIG. 13, tubular piston 40 is shown as having moved axially downhole (to the right in FIG. 13) in response to the application of the pressure force thereto, revealing an expansion chamber 23 formed in uphole housing 20 which increases in volume as the tubular piston 40 strokes axially downhole. As described above, axial movement downhole of the tubular piston 40 relieves the lock ring 50 so that the circumferential ridges 55 of lock ring 50 may travel radially inwards from the circumferential inner locking groove 85 placing lock ring 50 thereby unlocking the lock ring 50 from the downhole housing 80. It should be noted that at least a portion of the expansion chamber 23 is part of the housing flow path 22.

Once fully stroked, one or more vents 26 of uphole housing 20 allow the combustion gasses to escape from the release tool 10 and into the surrounding environment (e.g., a subterranean wellbore environment) so as to depressurize the release tool 10, avoiding the hazard of an operator opening the tool 10 in a pressurized state (which may release pressure unexpectedly) at the surface following deployment of the tool 10 into a wellbore. Also, as a precaution to unintentional stroking of the tubular piston 40, shear screws 42 and 43 (shown in FIGS. 11 and 12) are used to prevent relative axial movement of the piston 40 (when in an unsheared state) until sufficient and considerable axial force is imposed by the combustion gasses through the module flowpath 65 to the top of the tubular piston 40.

Referring again to FIGS. 11 and 12, in this exemplary embodiment, the mandrel 30 of release tool 10 includes a primary shear slot 34 shown on a top side of the mandrel 30 and in which the shear screw 42 is received, and a secondary shear slot 35 circumferentially spaced from primary shear slot 34 and in which the shear screw 43 is received. Shear screw 42 may be referred to herein as primary shear screw 42 while shear screw 43 may be referred to herein as secondary shear screw 43. The principle difference between the primary shear slot 34 and the secondary shear slot 35 in this exemplary embodiment is that the primary shear slot 34 has a shorter axial length (extending radially within the release tool 10) than the secondary shear slot 35 where, in this exemplary embodiment, the difference in axial length between slots 34 and 35 is greater than the thickness of the primary shear screw 42. By this arrangement, the primary shear screw 42 may absorb forces applied to the release tool 10 prior to an activation of the tool 10 from the locked state to the released state. For example, primary shear screw 42 may absorb vibratory forces incurred, for example, during shipping of the release tool 10, during multiple deployment cycles into one or more wellbores with various prior toolstrings, etc. However, in other embodiments, the relative axial lengths of shear screws 42 and 43 may vary from that disclosed herein. In still other embodiments, release tool 10 may include only one shear screw (e.g., primary shear screw 42).

By absorbing these forces prior to the activation of release tool 10, primary shear screw 42, which may be damaged to some degree by the forces applied thereto, protects the secondary shear screw 43 from damage (e.g., accruing from the forces that are instead applied to primary shear screw 42) thereby preserving its full rated strength. As such, the combustion gasses produced by combustion element 63 drives the tubular piston 40 downhole shearing off the primary shear screw 42 with its end extending into the primary shear slot 34 whether the primary shear screw 42 is fully intact or compromised by age and vibration in response to the intentional activation of release tool 10 to separate and thereby release the downhole housing 80 from the upper assembly 25.

Figure 11:
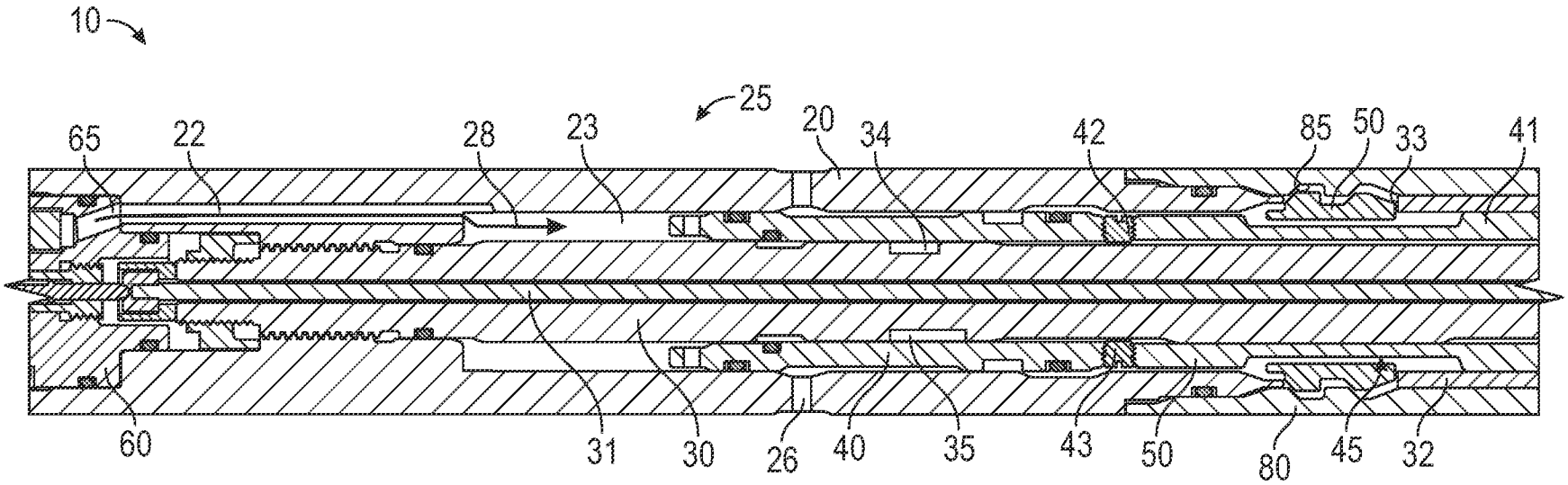
FIG. 11 is an enlarged, fragmentary elevation cross-sectional view of the release tool similar to FIG. 10 with a stroked slide piston and the lock ring being unlocked.
Figure 12:
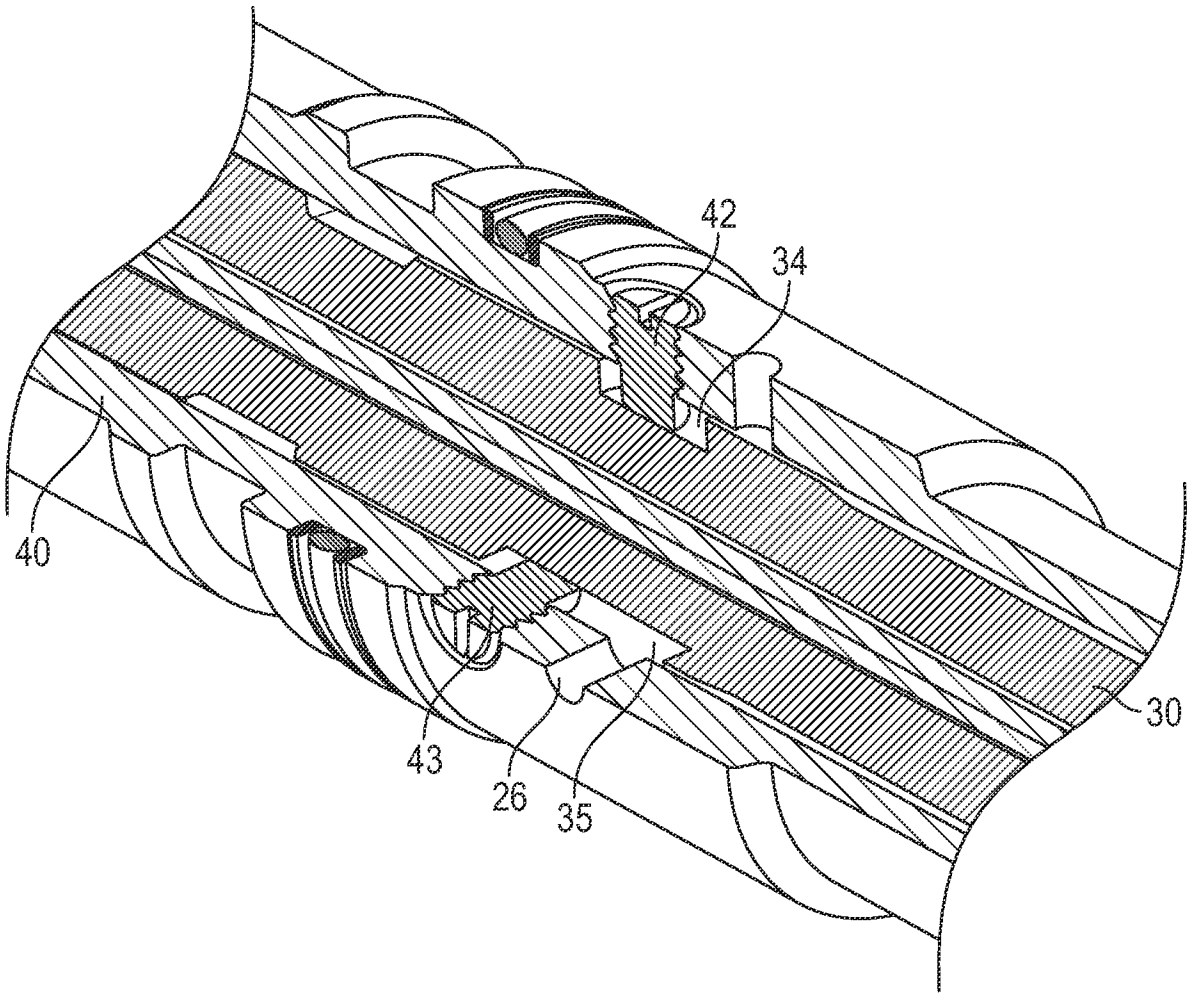
FIG. 12 is a quarter-sectioned perspective view of the release tool showing the shear screw arrangement preventing unintentional actuation.

Additionally, as the tubular piston 40 progresses slightly further downhole following the shearing of primary shear screw 42 (before the wide circumferential relief groove 45 on the periphery of the tubular piston 40 enters radially inside the lock ring 50), the secondary shear screw 43 must first be sheared by the mandrel 30 (placing the shear screw 43 into a sheared state) before the tubular piston 40 can fully stroke as shown particularly in FIG. 11 (with shear screws 42 and 43 each sheared into their respective sheared states). It may be understood that when the combustion element 63 is ignited, there is more than sufficient energy to shear off both of the shear screws 42 and 43, and the shear screws are only installed to prevent inadvertent stroking of the tubular piston 40 due to other causes that may not fully stroke and enable a full and certain transition of the release tool 10 into the released state. As shown particularly in FIG. 12, the shear screws 42 and 43 may be used in pairs (e.g., a pair of primary shear screws 42 and a pair of secondary shear screws 43) where the primary shear screw 42 and primary shear slot 34 are circumferentially spaced approximately 180 degrees opposite one another and the secondary shear screw 43 and secondary shear slot 35 are circumferentially spaced approximately 90 degrees from each of the primary shear screws 42 and primary shear slots 34, but approximately 180 degrees from one another.

After the shear screws 42 and 43 are sheared and the tubular piston 40 fully strokes bringing the wide circumferential relief groove 45 into an axially overlapping alignment with the lock ring 50 (releasing the wedging structure that had prevented the circumferential ridges 55 on the periphery of the lock ring 50 from releasing from the circumferential inner locking groove 85 on the inside of the downhole housing 80), a relief area is provided for the lock ring to recess into as the lock ring 50 squeezes itself out of the circumferential inner locking groove 85. The tension on the upper assembly 25 imposed from the wireline (not shown) forces the load shoulder 33 axially against the lower, blunt end of the lock ring 50, thereby pressing the lock ring 50 into the contracted state as shown in FIG. 9 and freeing the upper assembly 25 from the downhole housing 80.

Figure 14:
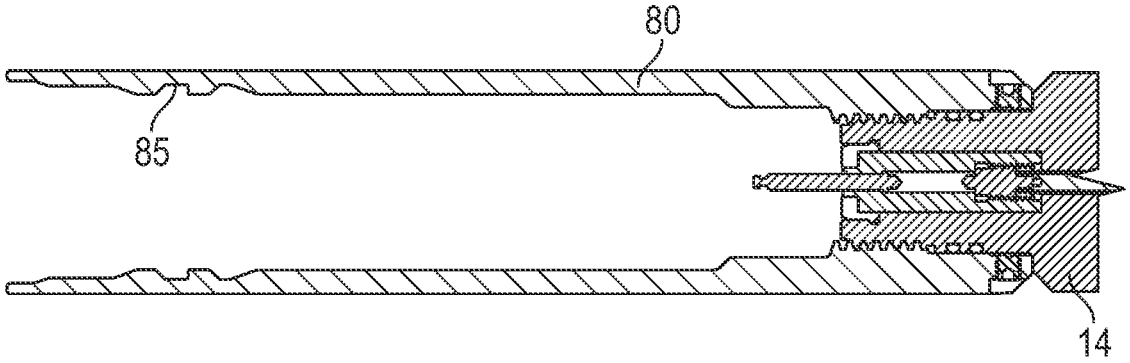
FIG. 14 is a cross-section view of the downhole housing of the release tool separated and free of the uphole assembly.

Referring to FIGS. 13 and 14, FIG. 14 particularly shows the upper assembly in its complete form now free of the downhole housing 80. Additionally, it may be noted that FIG. 13 shows the lock ring 50 assuming a preferred shape (e.g., the contracted state) while the lock ring 50 remains captured by the load shoulder 32 and lifted to the surface assembly 4. FIG. 14 illustrates the downhole housing 80 which is connected to the remainder of the toolstring through bottom sub 14. The open tubular shape of the uphole end of the downhole housing 80 is a familiar shape for fishing systems that are deployed to well sites to recover tools and equipment that are stuck downhole.

In summary, in this exemplary embodiment, the weight of the toolstring 5 is carried by the release tool 10. Particularly, axially directed load or tension applied to the release tool 10 is carried by the downhole housing 80 being screwed to the bottom sub, the lock ring 50 being held into the inner locking groove 85 and the lock ring 50 also blocking upward movement of the load shoulder 33. Given that the load shoulder 33 is part of the catch sleeve 32 (which is screwed to the bottom end of the mandrel 30, mandrel 30 being screwed to the uphole housing 20 at the uphole end of the mandrel 30 and the uphole housing 20 being screwed to the top sub 12), the uphole and downhole housings 20 and 80 are secured together in a locked state. In addition, uphole housing 20, mandrel 30 and downhole housing 80 are each in tension while the catch sleeve 32 and the lock ring 50 are each in compression.

When the tubular piston 40 has been driven down along the mandrel 30, the movable wedge 41 becomes positioned below the lock ring 50 such that the lock ring is no longer prevented from transitioning to the contracted state having a smaller radius (see FIG. 9). In this configuration, the tension applied to the wireline 6 may be at or increased to deliver sufficient compressive force on the downhole end of the lock ring 50 to cause the ramp-like configuration of the inner locking groove 85 along with the shape of the ridge of the lock ring 50 to contract sufficiently to release the frictional coupling formed between the lock ring 50 and the inner locking groove 85. As such, release tool 10 may have its locking mechanism (e.g., lock ring 50) in an unlocked state, but not have the uphole housing 20 released and separated from the downhole housing 80 until and following the application of sufficient tension to the wireline 6. In at least some instances, should the perforating guns 8 of toolstring 5 become unstuck from the cased wellbore 2, the toolstring 5 can be recovered at the surface while the release tool 10 is unlocked. But this scenario is generally unlikely as there would more than likely be sufficient efforts to yank and pull on the stuck toolstring 5 with very high tensile force before the actuation of the actuation module 60. The magnitude of the tension necessary to pull the lock ring 50 from the inner locking groove 85 would be considerably less than the maximum tension previously applied when trying to pull the toolstring 5 to the surface, tending to make a full return of the toolstring 5 very unlikely.

Also, in summary, the process for releasing release tool 10 may include transmitting a release signal to the actuation module 60 (e.g., an actuation specifically and uniquely addressed to the electronic switch 66 of actuation module 60. The process may additionally include igniting or combusting the combustion element 63 in response to the actuation module 60 receiving the release signal, thereby producing combustion gasses which increase pressure within the combustion flowpath 28 eventually driving or propelling the tubular piston 40 downhole along the mandrel 30 until the movable wedge 41 moves axially out from behind the lock ring 50 and aligning the wide circumferential relief groove 45. With the movable wedge 41 aligned with relief groove 45, lock ring 50 is allowed to unlock. In some embodiments, the process for releasing the release tool 10 further includes applying tension to the mandrel 30 (e.g., via wireline 6) and pressing the lock ring 50 out of the inner locking groove 85 by the action of the load shoulder 33 against the downhole end of the lock ring 50 such that the upper assembly 25 fully exits and disconnects from the downhole housing 80.

Turning to FIGS. 18-21, another embodiment of an actuation module 100 for a release tool (e.g., for use in release tool 10 in lieu of actuation module 60 described above) is shown. Actuation module 100 generally includes a switch compartment 102 for receiving a wiring chassis 105. The wiring chassis 105 includes electrical posts 106 for attaching corresponding electrical ring terminals to one another and associated wire channels 107. The posts 106 and ring terminals provide a highly reliable form of electrical connection along with a simple means for testing and inspecting the wiring in the actuation module 100. Moreover, the wire channels 107 provide natural organization of the wiring for quicker and more confident visual inspections. The orienting pins 101 are not shown in FIGS. 18 and 19 but the ground springs 108 are shown.

Figure 20:
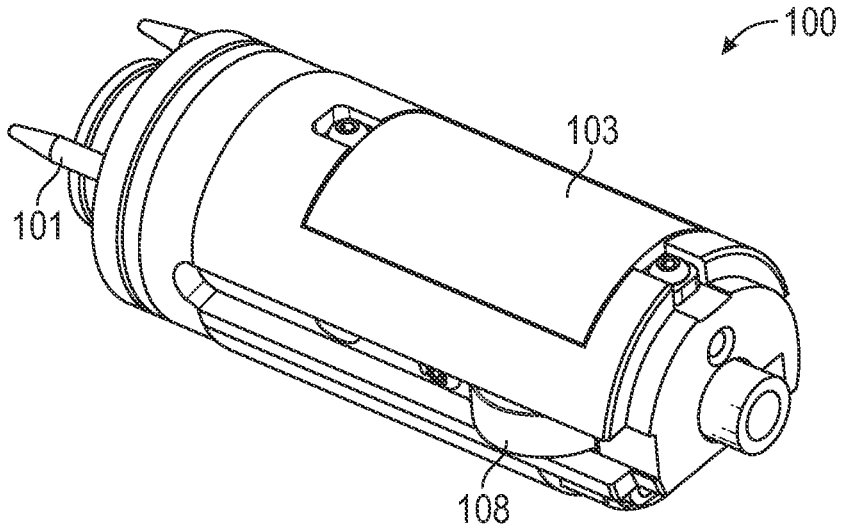
FIG. 20 is a perspective view of the additional embodiment of the actuation module with a cover secured over the wiring chassis and switch.
Figure 21:
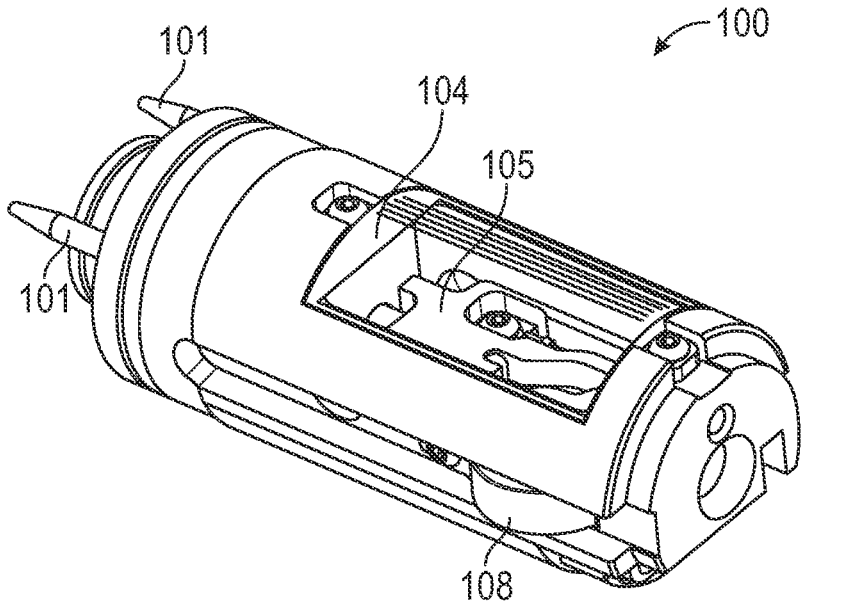
FIG. 21 is a perspective view of a further additional embodiment of the actuation module with a see-through or transparent cover so that the wiring and switch are viewable, but not accessible.

In FIGS. 20 and 21, an opaque cover 103 is shown in FIG. 20 to keep dust, debris, and curious fingers out of the switch compartment 102. Alternatively, FIG. 21 illustrates a translucent cover 104 which may be preferable in some embodiments.

Figure 22:
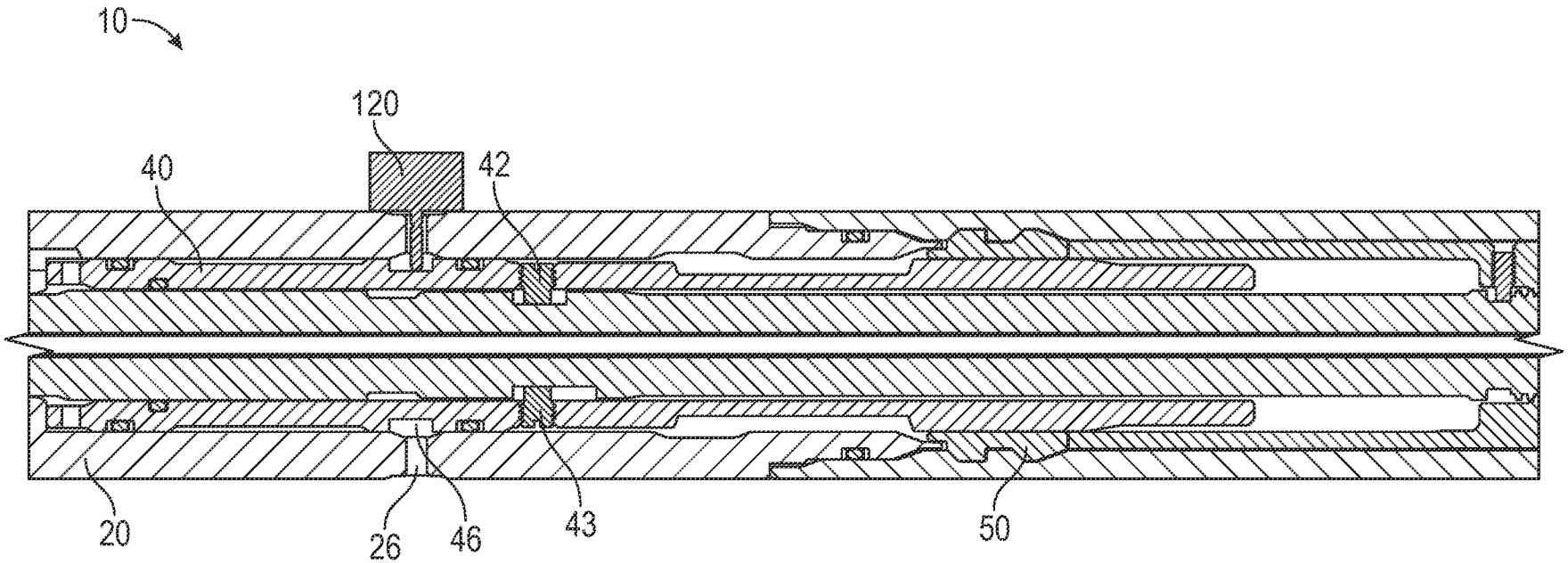
FIG. 22 is a cross section view showing a simple inspection tool for determining the stroking condition of the slide piston and identifying a first stroke condition.
Figure 23:
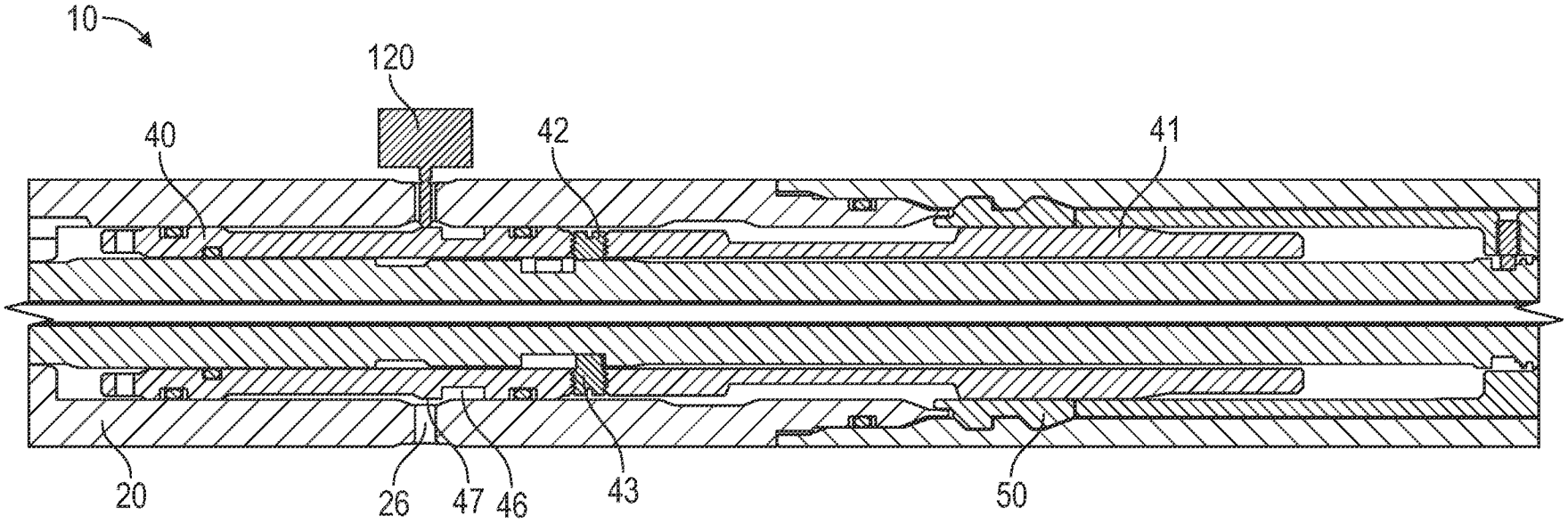
FIG. 23 is a cross section view showing the simple inspection tool for determining the stroking condition of the slide piston and identifying a second stroke condition.
Figure 24:
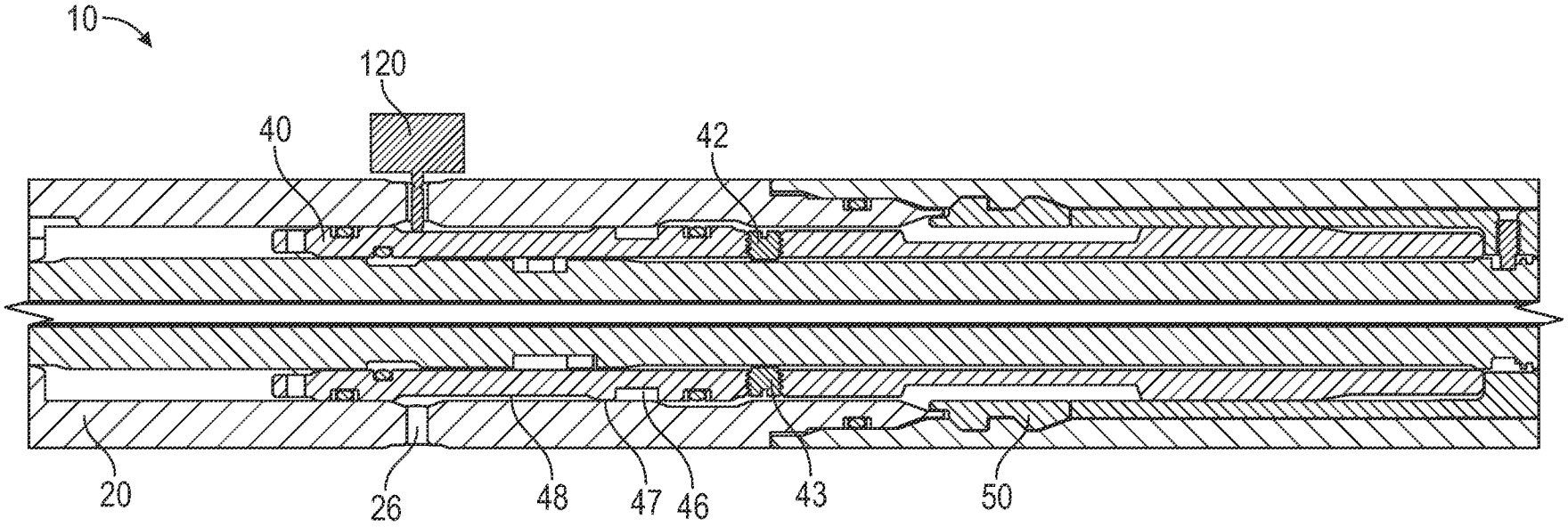
FIG. 24 is a cross section view showing the simple inspection tool for determining the stroking condition of the slide piston and identifying a third stroke condition.

Referring to FIGS. 22-24, an inspection tool 120 is shown for facilitating the convenient and quick inspection of downhole tool 10 following a deployment cycle, the inspection serving to ensure the internal structure of downhole tool 10 has not inadvertently (partially or fully) stroked. In other words, inspection tool 120 may allow for a rapid determination of whether the downhole tool 10 has inadvertently been transitioned from the locked state (e.g., either fully or partially into the released state).

Specifically, for every deployment of a release tool 10, it is strongly desired that both the primary shear screw 42 and secondary shear screw 43 remain fully intact. For example, in some instances after several deployments release tool 10 may be inadvertently partially stroked due to the forces imparted on the release tool 10 during a deployment cycle (e.g., impulses and blasts and the ordinary bumps and banging of going up and down a multiple mile wellbore). In the event that the tubular piston 40 has not stroked (as intended), the inspection key 120 may be inserted into vent 26 and settle fully to its bottom such that the bottom tip of the inspection key 120 reaches down into an unstroked inspection groove 46 formed along the radially outer surface of piston 40 as shown in FIG. 22. In the event that the release tool 10 inadvertently partially strokes such that the primary shear screw 42 has sheared but the secondary shear screw 43 remains intact to prevent the tubular piston 40 from fully stroking as seen in FIG. 23, the tip end of the inspection key 120 contacts a partially stroked inspection ring 47 formed along the radially outer surface of mandrel 40 (and axially spaced from unstroked inspection groove 46), resulting in a base of the inspection key 120 (longitudinally opposite the tip of key 120) projects or stands proud of the uphole housing 20. It should be noted that even though the lock ring 50 is bolstered by the moveable wedge 41, it is generally not advised that a release tool 10 in the condition shown in FIG. 23 should be deployed downhole with the primary shear screw(s) 42 in the sheared state. In this manner, the partially stroked inspection ring 47 of piston 40 is designed to prevent future deployment of the release tool 10 in this partially stroked configuration shown in FIG. 23.

In the event that the release tool 10 is (intentionally or inadvertently) fully stroked, the downhole housing 80 will most likely be disconnected from the uphole assembly 25. However, there may be circumstances where the release tool 10 fully strokes but does not disconnect because the tool string 5 was not sufficiently stuck to create sufficient tension to fully extract the uphole assembly 25 from the downhole housing 80. Regardless, a release tool 10 in this condition should not be re-deployed into another wellbore 2.

An example of a fully stroked yet connected release tool 10 is shown in FIG. 24. The connection formed between uphole assembly 25 and downhole housing 80 may appear intact to an operator of the release tool 10 due to the spring force of the lock ring 50, however, such a connection is insufficiently strong to prevent the release tool 10 from fully disconnecting (e.g., fully entering the released state) in a subsequent deployment cycle. of the presence of a stroked but connected release tool 10 may be identified by the inspection key 120, upon insertion, being receives in a fully stroked inspection recess 48 formed along the radially outer surface of mandrel 40. Fully stroked inspection recess 48 has a shallower radial depth than the unstroked inspection recess 46, thereby preventing inspection key 120 from fully bottoming out against the release tool 10. While the inspection key 120 may be inserted slightly further in this configuration than in the configuration shown in FIG. 23, neither condition is acceptable (e.g., should be an identified by an inspector as an inspection failure) and the failing release tool 10 should be pulled from service until disassembled, inspected and reconditioned.

Turning to another aspect of the present disclosure, the combustion element 63 is designed and sized to drive the tubular piston 40 from its unstroked position to its fully stroked position and have sufficient extra energy to overcome potential resistance (e.g., frictional drag) to the piston 40 as it is stroked. As a consequence, the tubular piston 40, once it has overcome the static friction applied by the mandrel 30 within the catch sleeve 32, may accelerate quickly to a high velocity with substantial excess energy for making a disconnection.

Figure 25:
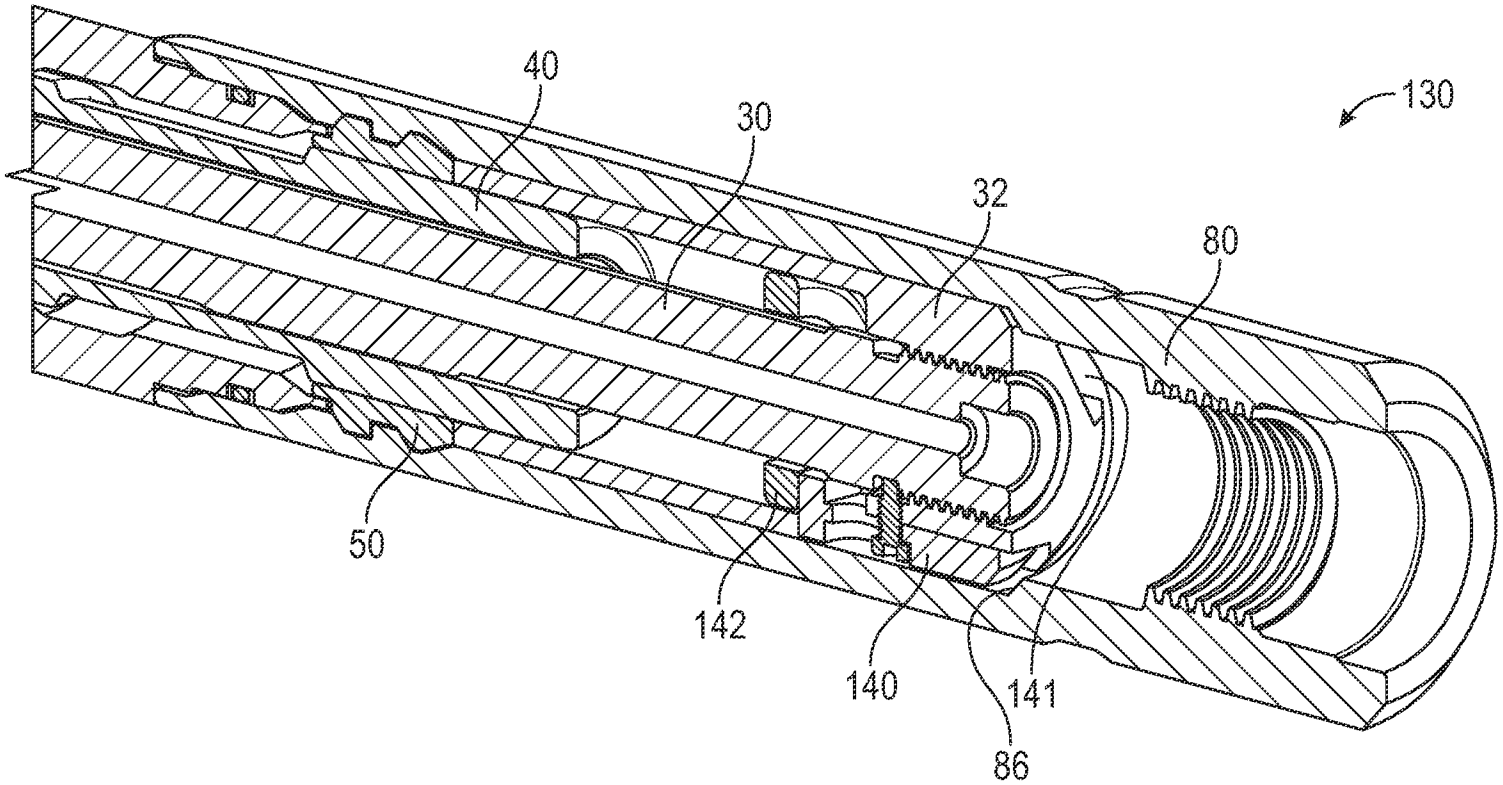
FIG. 25 is a cross sectional perspective view of the slide piston showing a further design option in the form of push-off lugs.
Figure 26:
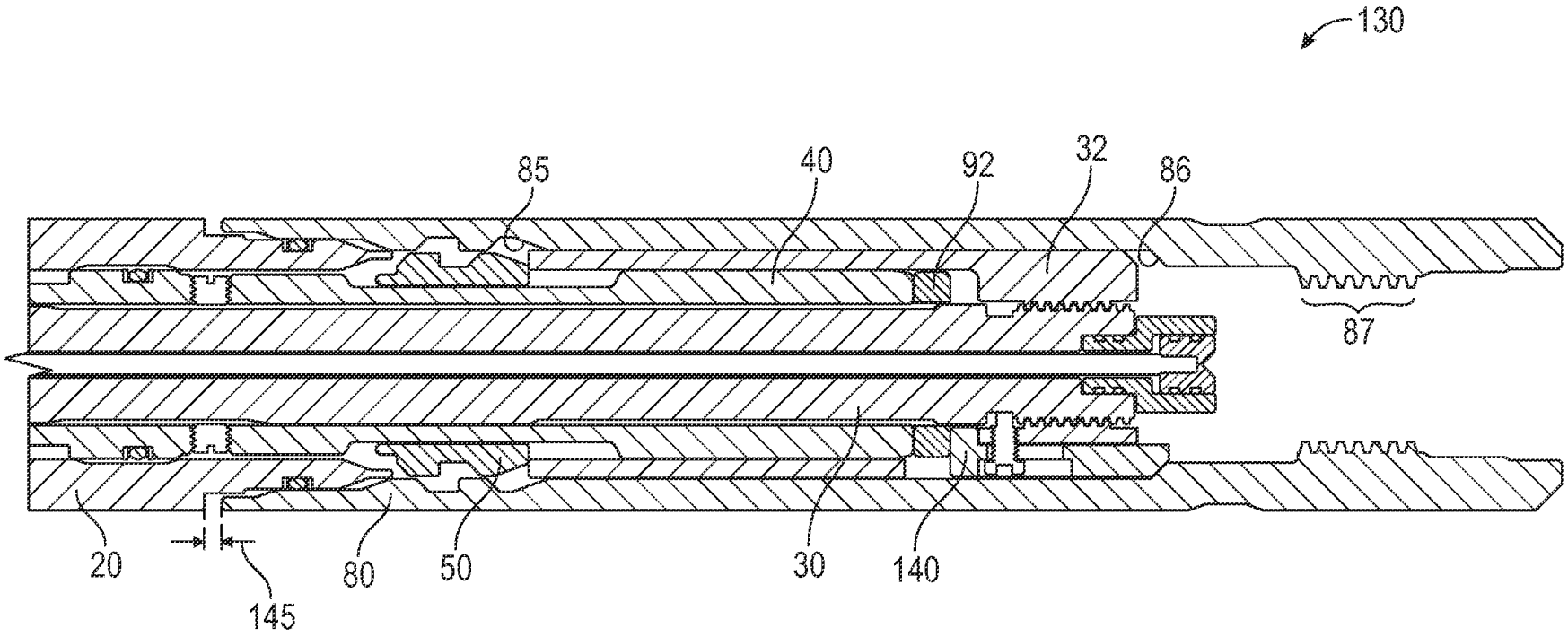
FIG. 26 is an elevation cross sectional view of the push-off lugs pressing the downhole housing off the bottom collar after stroking of the tubular piston.

Referring now to FIGS. 25 and 26, an embodiment of a release tool 130 is shown in which the excess energy of the piston 40 is utilized in dislodging the lock ring 50 from the circumferential inner groove 85 and disconnecting the downhole housing 80 from the uphole assembly 25. Specifically, release tool 130 includes push-off lugs 140 provided in lug channels 141 (three are provided in the embodiment shown) that are spaced from a push-off shoulder 86 of the downhole housing 80 of release tool 130. Upon stroking of the tubular piston 40, the downhole end of the tubular piston 40 engages a lug ring 142 of release tool 130. Lug ring 142 may comprise a polymer to absorb some shock and may alternatively comprise a steel to transfer the energy to the push-off lug 140. The push-off lugs 140 are driven downwardly toward and against the push-off shoulder 86 as best shown in FIG. 26, thereby forcing the uphole housing 20 off of the downhole housing 80 as seen as the initial disconnecting gap 145 which is created prior to any additional tension being imposed by the wireline 6. It should be further noted that the mandrel 30 and catch sleeve 32 are moved relative to the downhole housing 80, and the lock ring 50 is shown compressed to a smaller diameter (e.g., compressed into the contracted state) and up and out of the circumferential inner groove 85 such that lock ring 50 is translated upwards (leftwards in the figure) relative to the downhole housing 80. And with the push-off lugs 140 effectively being connected to the spring force of the lock ring 50, the impact of the tubular piston 40 may be slowed in at least a somewhat shock absorbing manner rather than a hard and potentially destructive impact which could damage components of the release tool 130.

Figure 27:
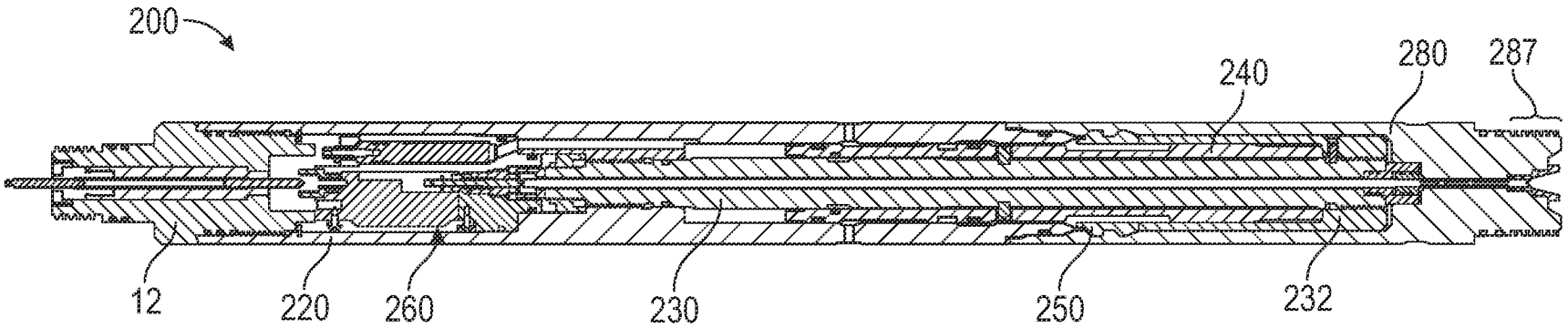
FIG. 27 is a cross section view of another additional aspect of the present disclosure where pin threads are provided at the base end of the downhole housing for directly connecting to a perforating gun or other tool without the need for a tandem sub.

Turning now to FIG. 27, another embodiment of a release tool 200 is shown which, while being configured similarly as release tool 10 described above, includes a simplification of the tool string 5. Release tool 200, similar to release tool 10 described above, includes a mandrel 230, a bottom collar 232, a tubular piston 240, a lock ring 250, an actuation module 260, and a downhole housing 280. However, unlike release tool 10 described above, release tool 200 does not include a bottom sub (e.g., bottom sub 14 shown in FIG. 14) coupled to a downhole end of downhole housing 280 via box end threads (e.g., box end threads 82 shown in FIG. 26) which requires two screw thread attachments to occur at the wellsite. Conversely, the downhole housing 280 of release tool 200 includes pin threads 287 which attach directly to the next planned tool located directly downhole from the release tool 200. Therefore, in this exemplary embodiment, only one connection at the bottom of the release tool 200 as compared to the two connections associated with release tool 10.

It is noted that exemplary embodiments have been disclosed, but there are many alternative designs consistent with the teachings of this disclosure such has having only one or, in the alternative, three or more circumferential inner locking groove 85 and circumferential ridges 55. Additionally, the Figures are not to scale and the proportions of components could be clearly altered from what is shown in the Figures.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

The invention claimed is:

1. A release tool for releasably securing a workstring to a downhole tool deployable into a wellbore extending through a subterranean earthen formation, the release tool comprising:

a downhole housing having a downhole end for connecting to the downhole tool and an uphole end opposite the downhole end; and an uphole assembly, comprising:

an uphole housing having an uphole end connectable to the workstring and a downhole end connectable to the downhole housing;

a lock ring configured to releasably secure the uphole housing to the downhole housing, wherein the lock ring has a locked state in which the lock ring is pressed outwardly towards a locking groove of the downhole housing whereby the lock ring is prevented from deflecting radially inwards, and an unlocked state in which the lock ring is allowed to deflect radially inwards away from the locking groove whereby the uphole housing may disconnect from the downhole housing;

a movable wedge moveable between a first position preventing the lock ring from transitioning from the locked state to the unlocked state and a second position permitting the lock ring to transition from the locked state to the unlocked state;

a combustion element configured to propel the movable wedge from the first position to the second position to release the downhole housing from the uphole housing in response the release tool receiving a release signal; and an actuation module housing the combustion element and an electronic switch configured to actuate the combustion element in response to receiving the release signal, wherein the actuation module is positioned at the uphole end of the uphole housing whereby the actuation module is removeable from the uphole housing without disassembling the lock ring from the movable wedge.

2. The release tool according to claim 1, wherein the uphole assembly further comprises a mandrel which extends into the downhole housing when the uphole assembly is connected to the downhole housing and wherein the mandrel carries the lock ring and an electrical contact for carrying electrical signals and/or data to the downhole tool.

3. The release tool according to claim 2, wherein the uphole assembly further comprises a piston carried on a periphery of the mandrel whereby the piston seals against both a periphery of the mandrel and a radially inner surface of at least one of the uphole housing and the downhole housing, and wherein the piston engages a radially inner surface of the lock ring with a surface defining the movable wedge.

4. The release tool according to claim 3, wherein the mandrel comprises a catch sleeve at a downhole end thereof, the catch sleeve comprising a ring shoulder projecting uphole towards the uphole housing with an annular space for the piston whereby the catch sleeve is configured to apply, in response to the application of tension against the uphole housing, an uphole directed compressive force against a downhole end of the lock ring sufficient to deflect the lock ring inwardly when the movable wedge is in the second position.

5. The release tool according to claim 3, further comprising:

a primary shear pin received in a primary groove formed in at least one of the piston and the mandrel whereby the primary shear pin frangibly retains the piston in a first axial position relative to the mandrel when in an unsheared state; and a secondary shear pin received in a secondary groove formed in at least one of the piston and the mandrel whereby the secondary shear pin frangibly retains the piston in the first axial position relative to the mandrel when in an unsheared state, wherein the secondary groove is greater in length along a central axis of the release tool than the primary groove such that the secondary shear pin is not subject to shearing in the secondary groove in response to the application of an axially directed force against the piston until the primary shear pin has been sheared in the primary groove.

6. The release tool according to claim 3, further comprising:

a primary shear pin received in a primary groove formed in at least one of the piston and the mandrel whereby the primary shear pin frangibly couples the piston to the mandrel when in an unsheared state; and a secondary shear pin received in a secondary groove formed in at least one of the piston and the mandrel whereby the secondary shear pin frangibly couples the piston to the mandrel when in an unsheared state, wherein the primary shear pin is configured to shear prior to the secondary shear pin in response to the application of an axially directed force against the piston.

7. The release tool according to claim 3, further comprising:

a primary shear pin received in a primary groove formed in at least one of the piston and the mandrel whereby the primary shear pin frangibly couples the piston to the mandrel when in an unsheared state; and a secondary shear pin received in a secondary groove formed in at least one of the piston and the mandrel whereby the secondary shear pin frangibly couples the piston to the mandrel when in an unsheared state;

wherein, when in the unsheared state, the primary shear pin is configured to divert axially directed forces applied to the release tool from the secondary shear pin.

8. The release tool according to claim 1, wherein the combustion element comprises a unitized ignitor and power cartridge.

9. The release tool according to claim 1, wherein the combustion element comprises low explosive configured to avoid the formation of a supersonic shockwave in response to ignition of the low explosive.

10. The release tool according to claim 1, wherein the actuation module comprises a heat shield that at least partially covers the electronic switch for insulating the electronic switch from at least some of heat present in the wellbore.

11. The release tool according to claim 1, wherein the actuation module comprises an initiator and an actuation housing that is sealingly received in at least one of the uphole housing and the downhole housing, and wherein the initiator is removeably positioned in a receptacle formed in the actuation housing whereby the initiator is removeable from the actuation housing with the actuation housing positioned in at least one of the uphole housing and the downhole housing.

12. The release tool according to claim 1, wherein the actuation module housing comprises an off-axis orienting pin that is radially offset from a central axis of the release tool, wherein the off-axis orienting pin is configured for maintaining a predefined relative orientation between the actuation housing and the downhole housing.

13. The release tool according to claim 1, wherein the uphole assembly further comprises at least one push-off lug axially translatable between a recessed position and an extended position and having an uphole face facing a downhole face of the moveable wedge and a downhole face facing the downhole housing, wherein the at least one push-off lug is configured to translate from the recessed position to the extended position as the moveable wedge translates from the first position to the second position whereby an axially directed downhole force is applied to the downhole housing by the downhole face of the at least one push-off lug in the extended position.

14. A release tool for releasably securing a workstring to a downhole tool deployable into a wellbore extending through a subterranean earthen formation, the release tool comprising:

an uphole housing connectable to the workstring;

a downhole housing connected to the uphole housing when the release tool is in a locked state and disconnected from the uphole housing when the release tool is in a released state;

a moveable wedge coupled to the uphole housing and positioned in the downhole housing;

a lock ring disposed in the downhole housing and having a locked state in which the lock ring is restricted from radially contracting by the moveable wedge to lock the downhole housing to the uphole housing, and an unlocked state in which the lock ring is permitted to radially contract thereby permitting the downhole housing to be released from the uphole housing;

an actuation module configured to move, in response to receiving a release signal, the moveable wedge relative to the lock ring to transition the lock ring from the locked state to the unlocked state;

a catch sleeve positioned in at least one of the uphole housing and the downhole housing for applying, in response to the application of tension to the release tool, a compressive force against the lock ring when in the locked state;

a mandrel which extends into the downhole housing, the mandrel comprising an electrical contact for carrying electrical signals and/or data, wherein the mandrel is coupled to the catch sleeve;

a piston carried on a periphery of the mandrel whereby the piston seals against the periphery of the mandrel and a radially inner surface of at least one of the uphole housing and the downhole housing:

a primary shear pin received in a primary groove formed in at least one of the piston and the mandrel whereby the primary shear pin frangibly couples the piston to the mandrel when in an unsheared state; and a secondary shear pin received in a secondary groove formed in at least one of the piston and the mandrel whereby the secondary shear pin frangibly couples the piston to the mandrel when in an unsheared state, wherein the secondary groove is greater in length along a central axis of the release tool than the primary groove.

15. The release tool according to claim 14, further comprising:

a primary shear pin received in a primary groove formed in at least one of the piston and the mandrel whereby the primary shear pin frangibly couples the piston to the mandrel when in an unsheared state; and a secondary shear pin received in a secondary groove formed in at least one of the piston and the mandrel whereby the secondary shear pin frangibly couples the piston to the mandrel when in an unsheared state, wherein the primary shear pin is configured to shear prior to the secondary shear pin in response to the application of an axially directed force against the piston.

16. The release tool according to claim 14, further comprising:

a primary shear pin received in a primary groove formed in at least one of the piston and the mandrel whereby the primary shear pin frangibly couples the piston to the mandrel when in an unsheared state; and a secondary shear pin received in a secondary groove formed in at least one of the piston and the mandrel whereby the secondary shear pin frangibly couples the piston to the mandrel when in an unsheared state;

wherein, when in the unsheared state, the primary shear pin is configured to divert axially directed forces applied to the release tool from the secondary shear pin.

17. The release tool according to claim 14, wherein the lock ring, when in the locked state, is at least partially received in an outer circumferential groove formed in the downhole housing.

18. The release tool according to claim 17, wherein the lock ring is released from the outer circumferential groove formed in the downhole housing when in the unlocked state.

19. The release tool according to claim 14, further comprising at least one push-off lug axially translatable between a recessed position and an extended position and having an uphole face facing a downhole face of the moveable wedge and a downhole face facing the downhole housing, wherein the at least one push-off lug is configured to translate from the recessed position to the extended position as the moveable wedge translates from a first position to a second position whereby an axially directed downhole force is applied to the downhole housing by the downhole face of the at least one push-off lug in the extended position.

20. A release tool for securing a workstring to a downhole tool deployable into a wellbore extending through a subterranean earthen formation, the release tool comprising:

a downhole housing having an uphole end, and a downhole end connectable to the downhole tool; and an uphole assembly, comprising:

an uphole housing having an uphole end connectable to the workstring and a downhole end connectable to the downhole housing;

a lock ring secured to the uphole housing and disposed within the downhole housing when the release tool is in a locked state, wherein the lock ring has a locked state in which the lock ring locks the uphole housing to the downhole housing, and an unlocked state in which the lock ring is unlocked from at least one of the uphole housing and the downhole housing such that the downhole housing is permitted to move relative to the uphole housing along a central axis of the release tool;

a piston having a first position that maintains the lock ring in the locked state and a second position that permits the lock ring to transition from the locked state to the unlocked state;

a combustion element configured to shift, in response to the uphole assembly receiving a release signal, the piston from the first position to the second position and thereby transition the release tool from the locked state to a released state in which the downhole housing is released from the uphole housing; and a lug ring positioned in the downhole housing, wherein a downhole end of the piston is configured to impact the lug ring in response to the release tool transitioning from the locked state to the released state to dissipate energy of the piston.

21. A release tool for releasably securing a workstring to a downhole tool deployable into a wellbore extending through a subterranean earthen formation, the release tool comprising:

an uphole housing and a downhole housing, wherein the uphole housing is connected to the downhole housing in a locked state of the release tool, and the uphole housing is released from the downhole housing in a released state of the release tool;

an inner locking groove formed on a radially inner surface of one of the uphole housing and the downhole housing with a lock ring nested into the inner locking groove;

a load shoulder configured to press against a downhole end of the lock ring in response to the application of tension against the uphole housing and the downhole housing;

a wedge that, in a locked state, prevents the lock ring from escaping the inner locking groove and, in an unlocked state, permits the lock ring to escape from the locking groove;

a piston in engagement with a radially inner surface of the lock ring with a surface defining the wedge:

a lug ring positioned in the downhole housing, wherein a downhole end of the piston is configured to impact the lug ring in response to the release tool transitioning from the locked state to the released state to dissipate energy of the piston; and a combustion element configured to transition the wedge from the locked state to the unlocked state.

22. The release tool according to claim 21, wherein the lock ring comprises a c-ring.

23. The release tool according to claim 21, wherein one of the uphole housing and the downhole housing comprises a radial passage in which an external inspection tool is insertable, and the piston comprises a first groove axially aligned with the radial passage when the piston is in an unstroked position corresponding to the locked state of the release tool, a second groove axially aligned with the radial passage when the piston is in a partially stroked position, and a third groove axially aligned with the radial passage when the piston is in a fully stroked position corresponding to the released state of the release tool.

24. The release tool according to claim 23, wherein the first groove has a first radial depth, the second groove has a second radial depth that is different from the first radial depth, and the third groove has a third radial depth that is different from the first radial depth and the second radial depth.

25. The release tool according to claim 21, further comprising a mandrel which extends into the downhole housing and carries the lock ring, wherein the lug ring is positioned in an annular space formed between the downhole end of the piston and a downhole end of the mandrel.

26. A release tool for releasably securing a workstring to a downhole tool deployable into a wellbore extending through a subterranean earthen formation, the release tool comprising:

an uphole housing and a downhole housing, wherein the uphole housing is connected to the downhole housing in a locked state of the release tool, and the uphole housing is released from the downhole housing in a released state of the release tool;

a piston positioned in at least one of the uphole housing and the downhole housing; and a low explosive combustion element configured to transition the release tool from the locked state to the released state in response to the release tool receiving a release signal, wherein the low explosive combustion element is configured to release combustion gases, which apply a downhole axially directed pressure force against an uphole end of the piston to thereby unlock the release tool.

27. The release tool according to claim 26, wherein the piston is displaceable from an unstroked position corresponding to the locked state of the release tool to a stroked position corresponding to the released state of the release tool in response to the generation by the low explosive combustion element of an axially directed pressure force applied against the piston.

28. A release tool for releasably securing a workstring to a downhole tool deployable into a wellbore extending through a subterranean earthen formation, the release tool comprising:

a downhole housing having a downhole end for connecting to the downhole tool and an uphole end opposite the downhole end; and an uphole assembly, comprising:

an uphole housing having an uphole end connectable to the workstring and a downhole end connectable to the downhole housing;

a lock ring configured to releasably secure the uphole housing to the downhole housing, wherein the lock ring has a locked state in which the lock ring is pressed outwardly towards a locking groove of the downhole housing whereby the lock ring is prevented from deflecting radially inwards, and an unlocked state in which the lock ring is allowed to deflect radially inwards away from the locking groove whereby the uphole housing may disconnect from the downhole housing;

a movable wedge moveable between a first position preventing the lock ring from transitioning from the locked state to the unlocked state and a second position permitting the lock ring to transition from the locked state to the unlocked state; and at least one push-off lug axially translatable from a recessed position to an extended position, wherein an uphole face of the at least one push-off lug faces a downhole face of the moveable wedge and a downhole face of the at least one push-off lug faces the downhole housing such that the at least one push-off lug translates from the recessed position to the extended position as the moveable wedge translates from the first position to the second position whereby an axially directed downhole force is applied to the downhole housing by the downhole face of the at least one push-off lug in the extended position;

a combustion element configured to propel the movable wedge from the first position to the second position to release the downhole housing from the uphole housing in response the release tool receiving a release signal, and a lug ring located axially between the downhole face of the moveable wedge and the uphole face of the push-off lug.

29. The release tool according to claim 28, wherein the lug ring comprises a polymeric material to absorb impact shock from the downhole face of the moveable wedge.

30. The release tool according to claim 28, wherein the downhole end of the downhole housing is defined by a pin-end connector for connecting directly with a corresponding box-end connector of the downhole tool.

* * * * *